US005816134A

United States Patent [19]

Takenaka et al.

[11] Patent Number: 5,816,134

[45] Date of Patent: Oct. 6, 1998

[54] COMPRESSOR PISTON AND PISTON TYPE COMPRESSOR

[75] Inventors: Kenji Takenaka; Hiroaki Kayukawa; Takahiro Hamaoka, all of Kariya; Takashi Michiyuki, Anjo; Mitsuru Hashimoto, Kariya; Masahiro Kawaguchi, Kariya, all of Japan

[73] Assignee: Kabushiki Kaisha Toyoda Jidoshokki Seisakusho, Kariya, Japan

[21] Appl. No.: 776,902

[22] PCT Filed: Jun. 5, 1996

[86] PCT No.: PCT/JP96/01510

§ 371 Date: Jun. 5, 1997

§ 102(e) Date: Jun. 5, 1997

[87] PCT Pub. No.: WO96/39581

PCT Pub. Date: Dec. 12, 1996

[30] Foreign Application Priority Data

Jun. 5, 1995 [JP] Japan ..... 7-138241

[51] Int. Cl.[6] ..... F01B 31/00

[52] U.S. Cl. ..... 92/154; 92/158; 92/159; 184/6.17; 184/18

[58] Field of Search ..... 92/12.2, 71, 153, 92/154, 158, 159, 160; 91/499; 184/18, 6.17; 417/269

[56] References Cited

U.S. PATENT DOCUMENTS

| | | | |
|---|---|---|---|
| 2,274,942 | 3/1942 | Touborg | 92/159 |
| 3,061,175 | 10/1962 | Schmidt | 92/158 |
| 3,106,138 | 10/1963 | Thoma | 92/187 |
| 3,153,987 | 10/1964 | Thoma | 92/71 |
| 3,866,519 | 2/1975 | Miyao et al. | 91/158 |
| 3,978,772 | 9/1976 | Miyao et al. | 92/158 |
| 4,108,048 | 8/1978 | Gauss et al. | 91/499 |
| 4,522,112 | 6/1985 | Nomura | 92/71 |
| 5,174,728 | 12/1992 | Kimura et al. . | |
| 5,382,139 | 1/1995 | Kawaguchi et al. . | |
| 5,461,967 | 10/1995 | Burkett et al. | 417/269 |

FOREIGN PATENT DOCUMENTS

| | | |
|---|---|---|
| 37-7540 | 7/1962 | Japan . |
| 43-18930 | 8/1968 | Japan . |
| 48-45209 | 6/1973 | Japan . |
| 53-38014 | 4/1978 | Japan . |
| 111985 | 4/1989 | Japan . |
| 4109481 | 9/1992 | Japan . |

*Primary Examiner*—Thomas E. Denion
*Attorney, Agent, or Firm*—Brooks Haidt Haffner & Delahunty

[57] ABSTRACT

A compressor has a piston (11) that reciprocates between a top dead center and a bottom dead center in a cylinder bore (2*a*) by means of a driving body (9) mounted on a rotary shaft (6) in a crank chamber (5) during the rotation of the rotary shaft (6). The piston (11) has an outer circumferential surface that slides against an inner circumferential surface of the cylinder bore (2*a*). The outer circumferential surface of the piston (11) is provided with a groove (17; 44; 46) extending in the direction of an axis (S) of the piston (11). During reciprocation of the piston (11), lubricating oil adhered to the inner circumferential surface of the cylinder bore (2*a*) is collected in the groove (17; 44; 46). When the groove (17; 44; 46) is exposed to the inside of the crank chamber (5) from the cylinder bore (2*a*) during the reciprocation of the piston (11), the lubricating oil in the groove (17; 44; 46) is supplied to the inside of the crank chamber (5). The lubricating oil lubricates the driving body (9) and other parts in the crank chamber (5).

33 Claims, 13 Drawing Sheets

COMPRESSOR PISTON AND PISTON TYPE COMPRESSOR

BACKGROUND OF THE INVENTION

1. Field of the Invention

The present invention relates to piston type compressors that convert rotation of a rotary shaft to linear reciprocating movement of a piston with a driving body such as a swash plate.

2. Description of the Related Art

Compressors are used to air-condition passenger compartments in vehicles. Piston type compressors are typically used for such compressors. The piston type compressor has a driving body, such as a swash plate, for a reciprocating piston. The driving body is supported by a rotary shaft in a crank chamber and converts the rotation of the rotary shaft to the linear reciprocating movement of the piston in a cylinder bore. The reciprocating movement of the pistons draws refrigerant gas into the cylinder bore from a suction chamber, compresses the gas in the cylinder bore, and discharges the gas into a discharge chamber.

The typical piston type compressor draws the refrigerant gas from an external refrigerant circuit into a suction chamber by way of the crank chamber. In such a compressor, in which the crank chamber constitutes a portion of a refrigerant gas passage, the refrigerant gas passing through the crank chamber sufficiently lubricates various parts in the crank chamber, such as the piston and the driving body, with the lubricating oil suspended in the gas.

There is also a type of compressor that draws in refrigerant gas from an external refrigerant circuit without having the gas flow through its crank chamber. Japanese Unexamined Patent Publication 60-175783 discloses such a compressor. In such a compressor, in which the crank chamber does not constitute a portion of the refrigerant gas passage, the various parts in the crank chamber are lubricated mainly by lubricating oil that is included in blowby gas. Blowby gas refers to the refrigerant gas in the cylinder bore that leaks into the crank chamber through the space defined between the outer circumferential surface of the piston and the inner circumferential surface of the cylinder bore when the piston compresses the refrigerant gas in the cylinder bore.

The amount of blowby gas, or lubricating oil, supplied into the crank chamber is determined by the dimension of the clearance defined between the outer circumferential surface of the piston and the inner circumferential surface of the cylinder bore. Accordingly, it is necessary to increase the dimension of the clearance to supply a sufficient amount of lubricating oil to satisfactorily lubricate the various parts in the crank chamber. However, a large clearance between the piston and the cylinder bore degrades the compressing efficiency of the compressor.

To cope with this problem, compressors having a structure such as that shown in FIGS. 22 and 23 are known in the prior art. The compressor shown in FIG. 22 has a swash plate 124, which serves as a driving body and which is mounted on a rotary shaft (not shown) so as to rotate integrally with the shaft. Shoes 125 are arranged between the swash plate 124 and the rear portion of a single-headed piston 122. Each shoe 125 has a spheric surface, which is slidably engaged with a retaining recess 122*a* of the piston 122, and a flat surface, which slides on the front or rear surface of the swash plate 124. When the rotary shaft and the swash plate 124 rotate integrally, the swash plate 124 serves to reciprocate the piston 122 in a cylinder bore 123 by means of the shoes 125.

The compressor shown in FIG. 23 has a wobble plate 128, which is mounted on a rotary shaft (not shown) and which rotates relatively with respect to the shaft. Rotation of the rotary shaft causes oscillating movement of the wobble plate 128. A rod 129 has a spheric body 129*a* formed on both of its ends. Each spheric body 129*a* is slidably held in either a retaining recess 128*a* of the wobble plate 128 or a retaining recess 126*a* of a piston 126. Rotation of the rotary shaft oscillates the wobble plate 128. The oscillation is transmitted to the piston 126 through the rod 129 and reciprocates the piston 126 in a cylinder bore 127.

In the above compressors, an annular groove 121 is defined in the outer circumferential surface of each piston 122, 126. Lubricating oil, adhered to the inner circumferential surfaces of the cylinder bores 123, 127, collects in the grooves 121 as the pistons 122, 126 are reciprocated. The grooves 121 are exposed to the inside of the crank chamber as they extend from the cylinder bores 123, 127 when the pistons 122, 126 move to the bottom dead center position. Accordingly, the lubricating oil collected in the grooves 121 is discharged toward the swash plate 124 and the wobble plate 128 (i.e., the crank chamber) when the grooves 121 are outside of the cylinder bores 123, 127. The coupling between the swash plate 124 and the wobble plate 128, the associated piston 122, 126, and other parts are lubricated by the lubricating oil. Thus, in compressors having such a structure, the various parts in the crank chamber may be satisfactorily lubricated without enlarging the dimension of the clearance between the pistons 122, 126 and the respective cylinder bores 123, 127, or without reducing the compressing efficiency of the compressor.

However, the compressors shown in FIGS. 22 and 23 also have the following disadvantages.

As the pistons 122, 126 approach the bottom dead center, the length of the pistons 122, 126 remaining in the associated cylinder bores 123, 127 becomes small. The pistons 122, 126 reciprocate within the associated bores 123, 127 in a manner such that they are supported by the inner circumferential surfaces of the cylinder bores 123, 127. As a result, when the length of the pistons 122, 126 accommodated in the associated bores 123, 127 is small, that is, when the portion of the pistons 22, 26 supported by the associated bores 123, 127, becomes small, the support by the bores 123, 127 is unstable and causes a loose fit. As shown exaggerated in FIGS. 22 and 23, this leads to interference between the edges of the grooves 121 in the pistons 122, 126 and the edges of the associated bores 123, 127. This not only hinders smooth reciprocation of the pistons 122, 126 but may also cause abrasive wear and damage of the edges of the grooves 121 in the pistons 122, 126 and the edges of the associated bores 123, 127.

In the compressor shown in FIG. 22, the rotating movement of the swash plate 124 is converted to the reciprocating movement of the piston 122 by means of the shoes 125. The compression reaction and inertial force of the piston 122 act on the swash plate 124 through the piston 122 when, for example, the piston 122 moves toward the top dead center from the bottom dead center to compress refrigerant gas. The force of the swash plate 124 acts on the piston 122, and a portion of the force acting on the piston 122 is applied in a direction such that the piston 122 presses against the inner circumferential surface of the bore 123. This is due to the swash plate 124 being inclined with respect to a plane perpendicular to the axis of the rotary shaft. Thus, in the compressor shown in FIG. 22, the groove 121 of the piston 122 hits the edge of the cylinder bore 123 with a stronger impact and causes the problem of abrasive wear and damage to become further prominent in comparison with the compressor shown in FIG. 23.

The object of the present invention is to provide a compressor piston for a compressor and a piston type compressor that is capable of moving pistons smoothly while also supplying a sufficient amount of lubricating oil to members which drive the pistons.

SUMMARY OF THE INVENTION

To achieve the above object, a piston of a compressor according to the present invention reciprocates between a top dead center and a bottom dead center in a cylinder bore by means of a driving body mounted on a rotary shaft in a crank chamber during the rotation of the rotary shaft. The piston has an outer circumferential surface that slides against an inner circumferential surface of the cylinder bore. The outer circumferential surface of the piston is provided with a groove extending in the direction of the axis of the piston.

Accordingly, during reciprocation of the piston, lubricating oil adhered to the inner circumferential surface of the cylinder bore collects in the groove. When the groove is exposed to the inside of the crank chamber from the cylinder bore during the reciprocation of the piston, the lubricating oil in the groove is supplied to the inside of the crank chamber. The lubricating oil lubricates the driving body and other parts in the crank chamber. The piston moves smoothly since the groove does not interfere with the edge of the cylinder bore. The groove also decreases the sliding resistance between the piston and the cylinder bore.

BRIEF DESCRIPTION OF THE DRAWINGS

FIG. 6(*b*) is a schematic drawing showing the optimal position for providing a second groove;

FIG. 11(*b*) is a perspective view showing a piston according to a further embodiment;

FIG. 11(*c*) is a perspective view showing a piston according to a further embodiment;

DETAILED DESCRIPTION OF THE PREFERRED EMBODIMENTS

A first embodiment of a piston type variable displacement compressor according to the present invention will hereafter be described with reference to FIGS. 1 through 7.

Figure 1:
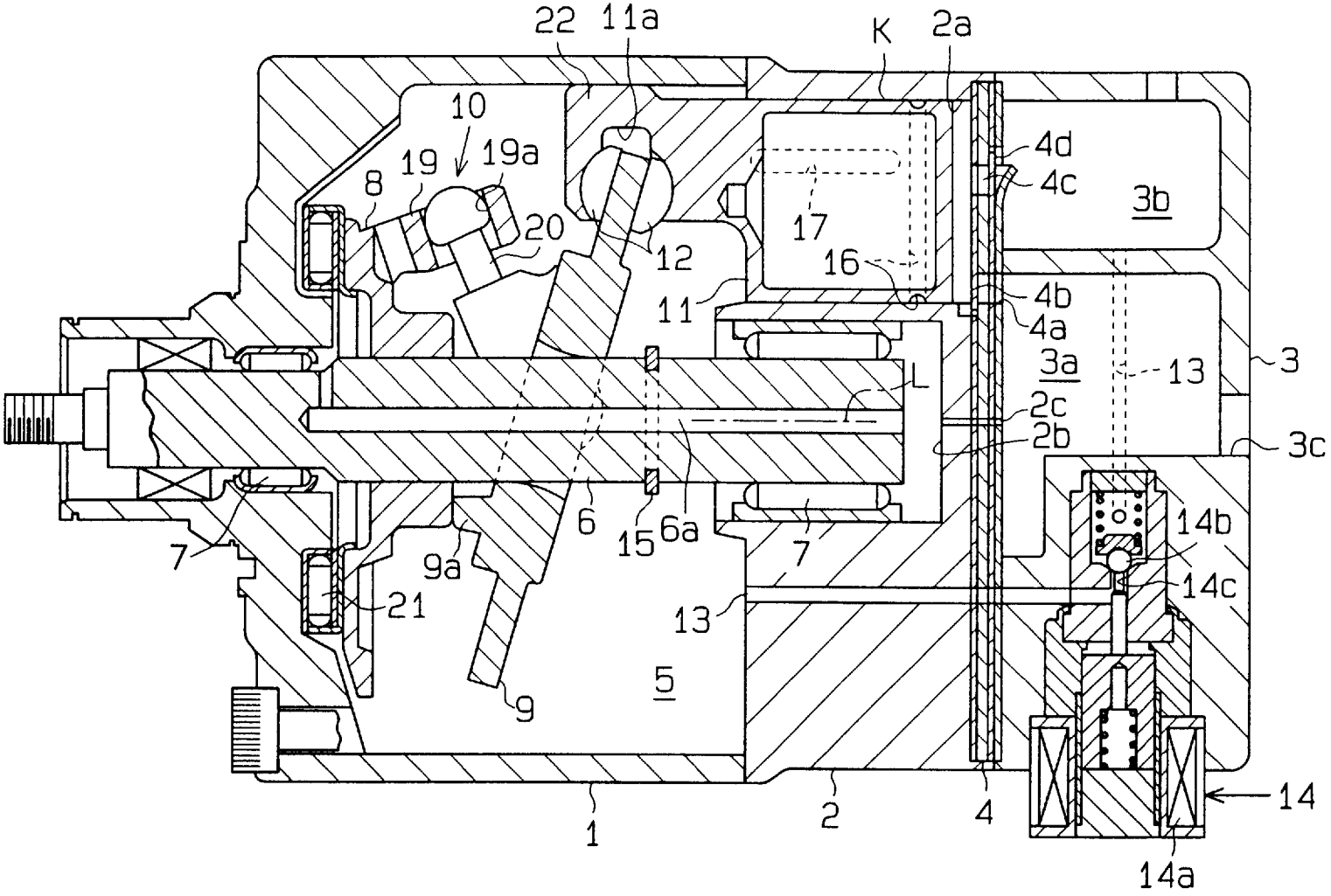
FIG. 1 is a cross-sectional view showing a first embodiment of a compressor according to the present invention.

As shown in FIG. 1, a front housing 1 is secured to the front end of a cylinder block 2. A rear housing 3 is secured to the rear end of the cylinder block 2 with a valve plate 4 arranged in between. The front housing 1, the cylinder block 2, and the rear housing 3 constitute the housing of the compressor. A suction chamber 3*a* and a discharge chamber 3*b* are defined between the rear housing 3 and the valve plate 4. Refrigerant gas sent from an external refrigerant circuit (not shown) is directly drawn into the suction chamber 3*a* through an intake port 3*c*.

The valve plate 4 is provided with suction ports 4*a*, suction valves 4*b*, discharge ports 4*c*, and discharge valves 4*d*. A crank chamber 5 is defined between the front housing 1 and the cylinder block 2. A rotary shaft 6 is rotatably supported by a pair of bearings 7 in the front housing 1 and the cylinder block 2 and extends through the crank chamber 5. A support hole 2*b* is defined in the center of the cylinder block 2. The rear end of the rotary shaft 6 is inserted into the support hole 2*b* and supported by the inner circumferential surface of the hole 2*b* by means of the bearing 7.

A lug plate 8 is fixed to the rotary shaft 6. A swash plate 9, which serves as a driving body, is supported in the crank chamber 5 by the rotary shaft 6 so that it is slidable and inclinable with respect to the axis L of the shaft 6. The swash plate 9 is connected to the lug plate 8 by a hinge mechanism 10. The hinge mechanism 10 is constituted by a support arm 19, which is defined on the lug plate 8, and a pair of guide pins 20, which are defined on the swash plate 9. The guide pins 20 are slidably fit into a pair of guide holes 19*a*, which are defined in the support arm 19. The hinge mechanism 10 integrally rotates the swash plate 9 with the rotary shaft 6. The hinge mechanism 10 also guides the movement and inclining of the swash plate 9 in the direction of the axis L.

A plurality of cylinder bores 2*a* are formed in the cylinder block 2 about the rotary shaft 6. The bores 2*a* extend along the direction of the axis L. A hollow single-headed piston 11 is retained in each cylinder bore 2*a*. A groove 11*a* is defined in the rear portion of the piston 11. A pair of shoes 12 are fit into the opposed inner walls of the groove 11*a* in a manner such that their semispheric portions are relatively slidable. The swash plate 9 is slidably held between the flat portions of the shoes 12. The rotating movement of the swash plate 9 is converted to linear reciprocating movement of the pistons 11 and causes each piston 11 to reciprocate forward and backward inside the cylinder bore 2*a*. During the suction stroke of the piston 11, in which it moves from the top dead center to the bottom dead center, the refrigerant gas flows through the suction port 4*a*, pushes and opens the suction valve 4*b*, and enters the cylinder bore 2*a*. During the compression stroke of the piston 11, in which it moves from the bottom dead center to the top dead center, the refrigerant gas in the cylinder bore 2*a* is compressed and discharged into the discharge chamber 3*b* as it flows through the discharge port 4*c* and pushes open the discharge valve 4*d*.

A thrust bearing 21 is arranged between the lug plate 8 and the front housing 1. A compression reaction force acts on the piston 11 as the refrigerant gas is compressed. The compression reaction force is received by the front housing 1 by way of the piston 11, the swash plate 9, the lug plate 8, and the thrust bearing 21.

As shown in FIGS. 1 to 4, a rotation restricting member 22 is provided integrally in the rear portion of the piston 11. The rotation restricting member 22 has a circumferential surface, the diameter of which is equal to that of the inner circumferential surface of the front housing 1. The circumferential surface of the rotation restricting member 22 contacts the inner circumferential surface of the front housing 1 to prohibit rotation of the piston 11 about its center axis S.

As shown in FIG. 1, a supply passage 13 connects the discharge chamber 3*b* with the crank chamber 5. An electromagnetic valve 14 is provided in the rear housing 3 arranged in the supply passage 13. Activation of a solenoid 14*a* in the electromagnetic valve 14 causes a valve body 14*b* to close a valve hole 14*c*. Deactivation of the solenoid 14*a* causes the valve body 14*b* to open the valve hole 14*c*.

A pressure releasing passage 6*a* is defined in the shaft 6. The releasing passage 6*a* has an inlet opened to the crank chamber 5 and an outlet opened to the inside of the support hole 2*b*. A pressure releasing hole 2*c* connects the inside of the support hole 2*b* with the suction chamber 3*a*.

When the solenoid 14*a* is activated and the supply passage 13 is closed, the high-pressure refrigerant gas in the discharge chamber 3*b* is not sent to the crank chamber 5. In this state, the refrigerant gas in the crank chamber 5 keeps flowing out into the suction chamber 3*a* through the pressure releasing passage 6*a* and the pressure releasing hole 2*c*. This causes the pressure level in the crank chamber 5 to approach the low pressure in the suction chamber 2*a*. Hence, the pressure difference between the inside of the crank chamber 5 and the inside of the cylinder bores 2*a* becomes small and causes the inclination of the swash plate 9 to become maximum, as shown in FIG. 1. This results in the displacement of the compressor to become maximum.

When the solenoid 14*a* is deactivated and the supply passage 13 is thus opened, the high-pressure refrigerant gas in the discharge chamber 3*b* is sent to the crank chamber 5 and increases the pressure in the crank chamber 5. As a result, the pressure difference between the inside of the crank chamber 5 and the inside of the cylinder bores 2*a* becomes large and causes the inclination of the swash plate 9 to become minimum. This results in the displacement of the compressor becoming minimum.

Abutment of a stopper 9*a*, which is provided on the front surface of the swash plate 9, against the lug plate 8 restricts the swash plate 9 from inclining beyond the predetermined maximum inclination. Abutment of the swash plate 9 and a ring 15, which is provided on the rotary shaft 6, restricts the swash plate 9 at the minimum inclination.

As described above, the pressure inside the crank chamber 5 is adjusted by opening and closing the supply passage 13 in correspondence with the activation and deactivation of the solenoid 14*a* of the electromagnetic valve 14. Alteration of the pressure inside the crank chamber 5 also alters the difference between the pressure in the crank chamber 5 that acts on the front side of the pistons 11 (left side as viewed in FIG. 1) and the pressure in the cylinder bores 2*a* that acts on the rear side of the pistons 11 (right side as viewed in FIG. 1). This alters the inclination of the swash plate 9. The alteration in the inclination of the swash plate changes the moving stroke of the pistons 11 and adjusts the displacement of the compressor. The solenoid 14*a* of the electromagnetic valve 14 is controlled by a controller (not shown) and selectively excited and de-excited in accordance with data such as that of the cooling load. In other words, the displacement of the compressor is adjusted in accordance with the cooling load.

Figure 2:
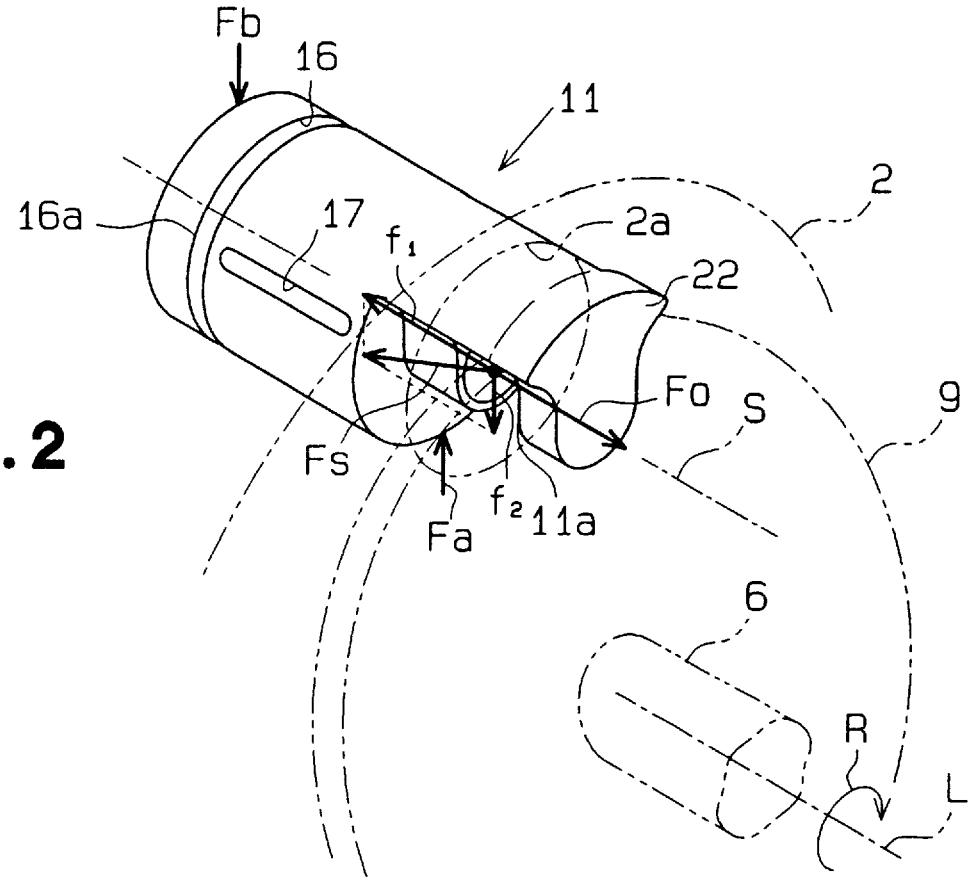
FIG. 2 is a perspective view showing a piston located at the top dead center.
Figure 3:
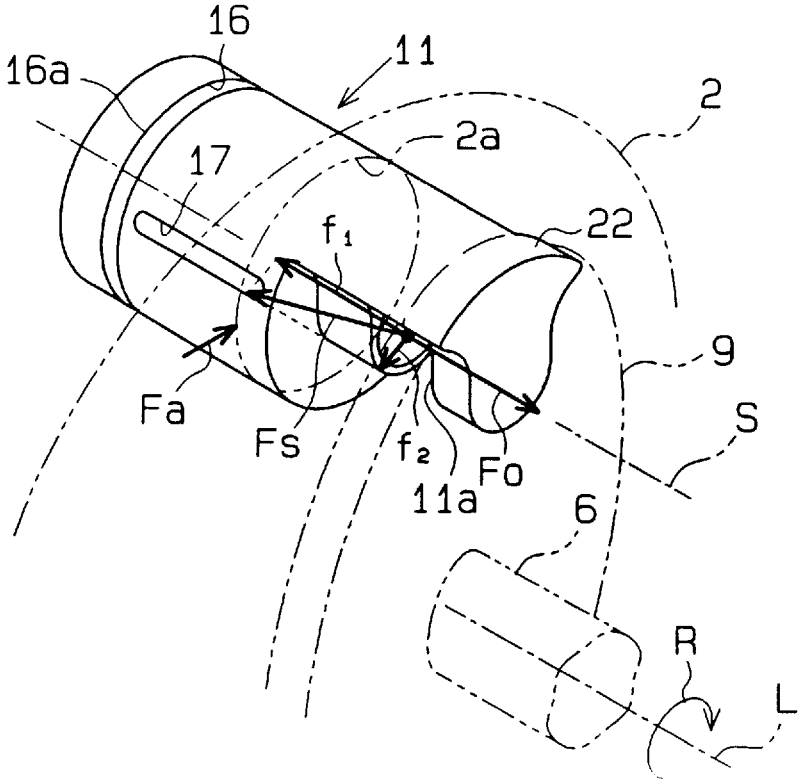
FIG. 3 is a perspective view showing the piston located between the top dead center and the bottom dead center.
Figure 4:
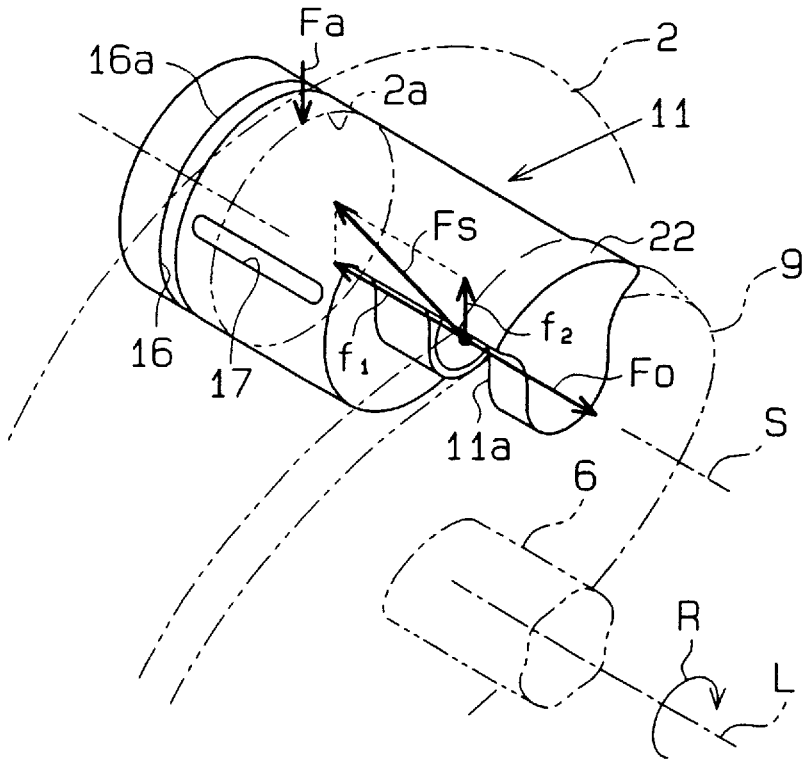
FIG. 4 is a perspective view showing the piston located at the bottom dead center.

As shown in FIGS. 1 through 5, a first annular groove 16, which serves as a recovering means, is defined in the front outer circumferential surface of each piston 11 extending in the circumferential direction. As shown in FIG. 4, the first groove 16, or recovering groove is defined at a position where the groove 16 is not exposed to the inside of the crank chamber 5 when the piston 11 is located at the bottom dead center. FIGS. 1 through 4 illustrate the swash plate 9 in a maximum inclination state.

Figure 6A:
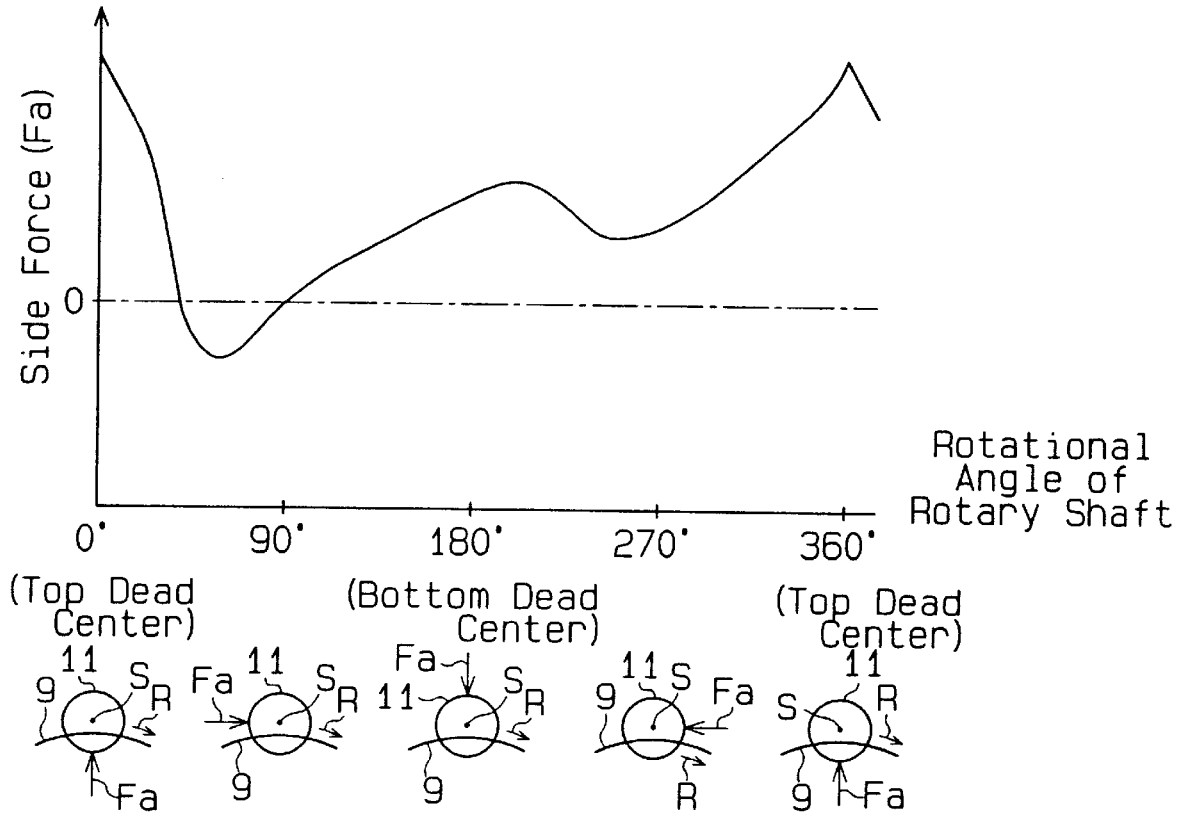
FIG. 6(*a*) is a graph showing the relationship between the rotational angle of the rotary shaft (location of the piston) and the level of the side force acting on the piston.
Figure 6B:
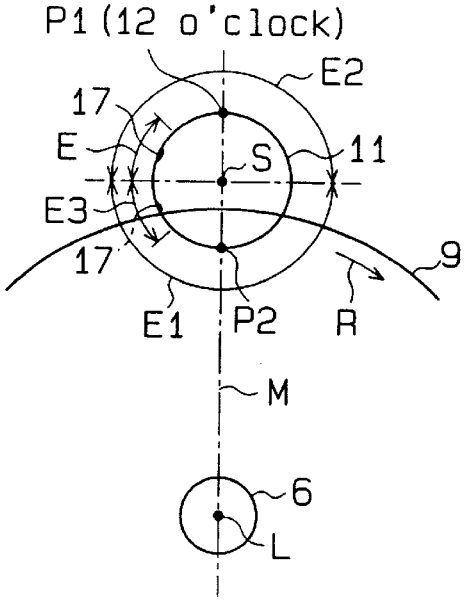

A second groove 17, which serves as a communicating means, is also defined in the outer circumferential surface of the piston 11 extending in the same direction as its center axis S. The basal end of the second groove 17, or communicating groove is located in the vicinity of the first groove 16. The second groove 17 is located on the circumferential surface of the piston 11 at a position described below. As shown in FIG. 6(*b*), when viewing the piston 11 so that the rotating direction R of the rotary shaft 6 is clockwise (in this drawing, the piston 11 is viewed from its rear side), an imaginary straight line M extends intersecting the axis L of the rotary shaft 6 and the axis S of the piston 11. Among the two intersecting points P1, P2 at which the straight line M and the circumferential surface of the piston 11 intersect, the position of the intersecting point P1, located at the farther side of the circumferential surface with respect to the axis L of the piston 11, is herein referred to as the twelve o'clock position. In this case, the second groove 17 is located within a range E, which is defined between positions corresponding to nine o'clock and ten thirty on the circumferential surface of the piston 11.

Figure 5:
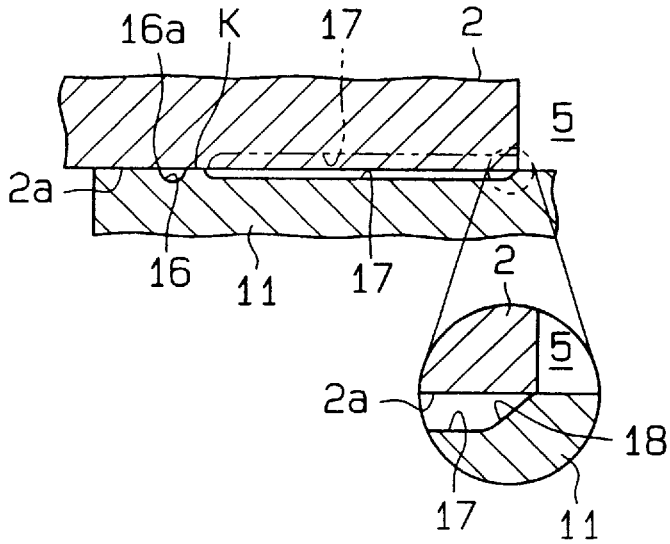
FIG. 5 is a partial enlarged cross-sectional view showing the piston including a further enlarged window.

As shown in FIG. 2, the position and length of the second groove 17 is determined so that it is not exposed from the cylinder bore 2*a* to the inside of the crank chamber 5 when the piston 11 moves near the top dead center. The second groove 17 is not connected with the first groove 16. As shown in FIG. 5, an inner bottom surface 18 defined at the distal side of the groove is sloped in a manner such that it is smoothly and continuously connected to the circumferential surface of the piston 11.

The surface of the piston 11 is ground using a centerless grinding method. The centerless grinding method, which is not shown, grinds the workpiece, or piston 11, which is held on a rest, by rotating it together with a grinding wheel without using a chuck to hold the piston 11. Therefore, if a plurality of second grooves 17 are provided in the circumferential surface of the piston 11, the rotating axis of the piston 11 placed on the rest becomes unstable. This hinders precision grinding. Accordingly, it is desirable that the number of second grooves 17 be minimized so as to enable accurate grinding when employing the centerless grinding method. In this embodiment, the piston 11 is provided with only a single second groove 17, the width and depth of which are minimized but are sufficient to supply lubricating oil to the crank chamber 5.

In the above compressor, when each piston 11 is moved from the top dead center to the bottom dead center during the suction stroke, the refrigerant gas in the suction chamber 3*a* is drawn into the cylinder bore 2*a*. During this stroke, a portion of the lubricating oil suspended in the refrigerant gas adheres to the inner circumferential surface of the cylinder bore 2*a*. Contrarily, when each piston 11 is moved from the bottom dead center to the top dead center during the compression stroke, the refrigerant gas in the cylinder bore 2*a* is compressed and then discharged into the discharge chamber 3*b*. During this stroke, a portion of the refrigerant gas in the bore 2*a* leaks into the crank chamber 5 through a narrow clearance K defined between the outer circumferential surface of the piston 11 and the inner circumferential surface of the bore 2*a* as blowby gas. Some of the lubricating oil contained in the blowby gas adheres to the inner circumferential surface of the bore 2*a*.

The lubricating oil adhered to the inner circumferential surface of the cylinder bore 2*a* is removed by the edge 16*a* of the first groove 16 of the piston 11 as the piston 11 reciprocates and is collected in the first groove 16.

During the compression stroke of the piston 11, the refrigerant gas leaking from the cylinder bore 2*a* (blow-by gas) increases the pressure in the first groove 16. The second groove 17 is entirely closed by the inner circumferential surface of the cylinder bore 2*a* only when the piston 11 is located near the top dead center. Otherwise, at least a portion of the second groove 17 is exposed to the inside of the crank chamber 5. Therefore, the pressure in the second groove 17 is equal to or slightly higher than the pressure in the crank chamber 5. The first groove 16 is connected to the second groove 17 by way of the narrow clearance K. Accordingly, during the compression stroke of the piston 11, the lubricating oil in the first groove 16 flows into the second groove 17 by way of the clearance K by the difference between the pressure in the first groove 16 and the pressure in the second groove 17. The lubricating oil that enters the second groove 17 flows into the crank chamber 5 by way of the portion of the second groove 17 that is exposed to the inside of the crank chamber 5. The lubricating oil is supplied to the coupling portion between the swash plate 9 and the piston 11, that is, between the swash plate 9 and the shoes 12 and between the shoes 12 and the piston 11. This satisfactorily lubricates these portions.

When the inclination of the swash plate 9 becomes small, the second groove 17 may not be exposed from the inside of the cylinder bore 2*a* even when the piston 11 is located at the bottom dead center. However, in this embodiment, the distance between the distal end of the second groove 17 and the rear edge of the piston 11 is short. Thus, the lubricating oil in the second groove 17 is easily discharged toward the crank chamber 5 by way of the clearance K. This satisfactorily lubricates the coupling portion between the swash plate 9 and the piston 11 among other parts.

In this manner, the lubricating oil collected by the first groove 16, which serves as a recovering means, is supplied to the crank chamber 5 by the second groove 17, which serves as a communicating means.

During the reciprocating movement of the piston 11, the reaction force from the inner circumferential surface of the cylinder bore 2*a* (hereafter referred to as the side force) produced by the compression reaction force and the inertial force of the piston 11 is received by the piston 11. Hence, it is preferable that the second groove 17 be provided at a position at which the influence of the side force is minimal (the position corresponding to range E as shown in FIG. 6(*b*)).

Figure 7:
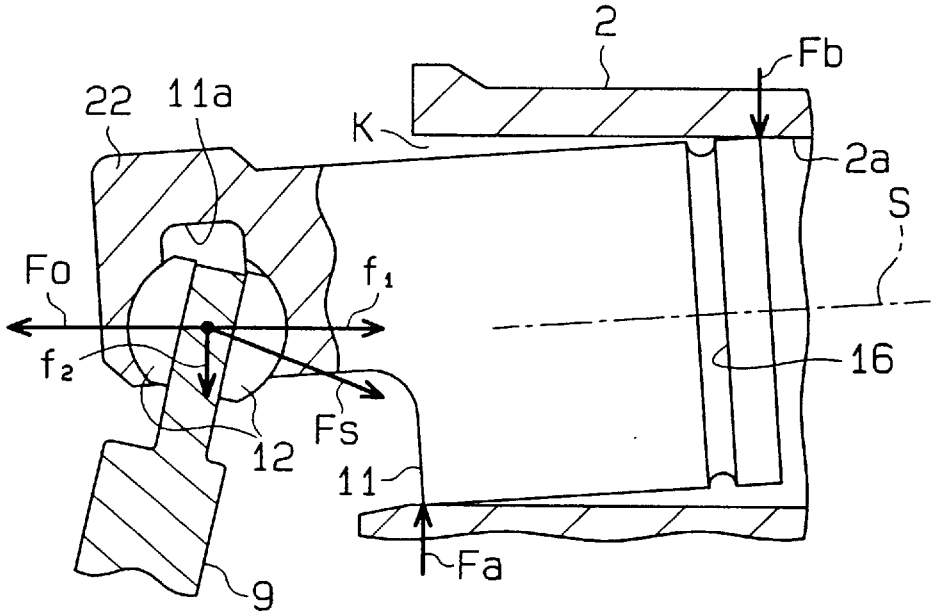
FIG. 7 is an enlarged cross-sectional view showing inclination of the piston located at the top dead center position in an exaggerated manner.

More particularly, as shown in FIG. 2 and FIG. 7, when the piston 11 is located near the top dead center, the compression reaction force that acts on the piston 11 becomes maximum. The compression reaction force and the inertial force of the piston 11 act on the swash plate 9. Accordingly, the piston 11 receives a large reaction force Fs in accordance with the resultant force Fo of the compression reaction force and the inertial force from the swash plate 9, which is inclined with respect to a plane that is perpendicular to the center axis L of the rotary shaft 6. In accordance with the inclination of the swash plate 9, the reaction force Fs is divided into a component force $f_1$, which is oriented along the moving direction of the piston 11, and a component force $f_2$, which is oriented toward the center axis L of the rotary shaft 6. The component force $f_2$ acts as a force that inclines the rear side of the piston 11 in the direction of the component force $f_2$. Thus, the circumferential surface of the rear side of the piston 11 is pressed against the inner circumferential surface of the cylinder bore 2*a* at the vicinity of its opening by a force corresponding to the component force $f_2$. In other words, the circumferential surface at the rear side of the piston 11 receives a large reaction force (side force) Fa corresponding to the component force $f_2$ from the inner circumferential surface of the cylinder bore 2*a* at the vicinity of its opening.

The position at which the side force Fa acts on the piston 11 varies as the piston 11 moves. For example, as the swash plate 9 rotates 90 degrees in the direction of arrow R from the state shown in FIG. 2 to the state shown in FIG. 3, the compressed refrigerant gas residing in the cylinder bore 2*a* re-expands as the piston 11 moves from the top dead center to the bottom dead center. When the swash plate 9 approaches the state shown in FIG. 3, the re-expansion of the compressed refrigerant gas in the cylinder bore 2*a* is completed and the suction of refrigerant gas into the cylinder bore 2*a* is commenced. In this state, the compression reaction force does not act on the swash plate 9 and the force Fo that acts on the piston 11 is mainly constituted by inertial force. Accordingly, the piston 11 receives the reaction force Fs, which is mainly constituted by inertial force. In accordance with the inclination of the swash plate 9, the reaction force Fs is divided into a component force $f_1$, which is oriented along the moving direction of the piston 11, and a component force $f_2$, which is oriented toward the rotating direction R of the swash plate 9. The component force $f_2$ acts as a force that inclines the rear side of the piston 11 in the direction of the component force $f_2$. Thus, the piston 11 receives a side force Fa corresponding to the component force $f_2$ from the inner circumferential surface of the cylinder bore 2*a* at the vicinity of its opening. As described later, when the swash plate 9 is in the state shown in FIG. 3, the force Fo acting on the swash plate 9 is substantially zero. Thus, practically no side force Fa acts on the piston 11.

When the swash plate 9 is further rotated 90 degrees in the direction of arrow R from the state shown in FIG. 3 to the state shown in FIG. 4, the piston 11 is located at the bottom dead center. In this state, the orientation of the component force $f_2$ that acts on the piston 11 becomes opposite to that of FIG. 2 (the state in which the piston 11 is located at the top dead center). Accordingly, the piston 11 receives a side force Fa oriented in the opposite direction to that of FIG. 2 from the inner circumferential surface of the cylinder bore 2*a* at the vicinity of its opening. The level of the side force Fa is greater than that of FIG. 2.

As shown in FIG. 2 and FIG. 7, the front portion of the piston 11 receives a side force Fb that corresponds to the component force $f_2$ from the inner circumferential surface of the cylinder bore 2*a* at its inner side. However, the first groove 16 is provided at the front side of the piston 11. The second groove 17 is provided at a position that is at least closer to the rear side of the piston 11 than the first groove 16. Accordingly, along the entire circumferential surface of the piston 11, the side force Fb does not act directly on the range between the basal end and distal end of the second groove 17. Therefore, the side force Fb that acts on the front side of the piston 11 need not be considered when determining the optimum position of the second groove with respect to the circumferential direction of the piston 11.

FIG. 6(*a*) illustrates a graph indicating the relationship between the rotational angle of the rotary shaft 6 (i.e., the location of the piston 11) and the level of the side force Fa acting on the piston 11. In this graph, the rotational angle of the rotary shaft 6 when the piston 11 is located at the top dead center corresponds to zero degrees. The schematic drawings provided under the longitudinal axis of the graph illustrates the orientation of the side force Fa acting on the piston 11 in correspondence with the rotational angle of the rotary shaft 6 indicated along the longitudinal axis. The schematic drawings show that the orientation of the portion of the piston 11 on which the side force Fa acts changes in the rotating direction R of the rotary shaft 6 as the rotary shaft 6 and the swash plate 9 rotate. In other words, the side force Fa acts sequentially along the entire circumference of the piston 11 as the piston 11 reciprocates once between the top dead center and the bottom dead center to perform the suction and compression strokes.

As shown in FIG. 6(*a*), as the rotary shaft 6 rotates 90 degrees from the state at which the piston is located at the top dead center, that is, as the swash plate 9 rotates from the state shown in FIG. 2 to the state shown in FIG. 3, the value of the side force Fa may become negative. This indicates that the orientation of each force shown in FIG. 3 reverses before the swash plate 9 reaches the state shown in FIG. 3.

The graph of FIG. 6(*a*) indicates that the side force acting on the piston 11 becomes maximal when the rotational angle of the rotary shaft 6 is zero degrees (=360 degrees), that is, when the piston 11 is located at the top dead center. As shown in FIG. 6(*b*), the location on the circumferential surface of the piston 11 that receives the maximum side force Fa corresponds to the six o'clock position. When a large side force Fa acts on the position corresponding to six o'clock, a range E1, which extends between the positions corresponding to three o'clock and nine o'clock about the six o'clock position on the circumferential surface of the piston 11, is strongly pressed against the inner circumferential surface of the cylinder bore 2*a*. Therefore, when the second groove 17 is provided within the range E1, the edge of the second groove 17 strongly presses the inner circumferential surface of the cylinder bore 2*a* and may thus cause abrasive wear or damage to the piston 11 and the cylinder bore 2*a*. Accordingly, it is preferable that the second groove 17 be provided on the circumferential surface of the piston 11 within a range excluding the range E1 that extends between three o'clock and nine o'clock, that is, range E2, which extends between nine o'clock and three o'clock.

To further avoid the influence of the side force Fa, it is preferable that the second groove 17 be provided in a range that receives minimal side force Fa within the range E2, which extends between nine o'clock and three o'clock on the circumferential surface of the piston 11. The graph of FIG. 6(*a*) indicates that the side force Fa acting on the piston 11 is relatively smaller during the suction stroke of the piston 11 (when the rotational angle of the rotary shaft 6 is within 0 degrees to 180 degrees) than during the compression stroke of the piston 11 (when the rotational angle of the rotary shaft 6 is within 180 degrees to 360 degrees).

After the re-expansion of the residual refrigerant gas in the cylinder bore 2*a* is completed during the suction stroke, the swash plate 9 is free from compression reaction force and the force acting on the piston 11 is mostly constituted by inertial force. In particular, as shown in FIG. 6(*a*), when the rotational angle of the rotary shaft 6 corresponds to 90 degrees (when the swash plate 9 is in the state shown in FIG. 3), there is almost no side force Fa acting on the circumferential surface of the piston 11 at the position corresponding to nine o'clock. Accordingly, the side force Fa acting on the piston 11 becomes relatively smaller during the suction stroke than during the compression stroke, in which compression reaction force is produced. In other words, within the range E2 extending between nine o'clock to three o'clock on the circumferential surface of the piston 11, the side force Fa acting in the range between nine o'clock to twelve o'clock is relatively smaller than the side force Fa acting in the range between twelve o'clock and three o'clock.

In addition, as shown in FIG. 6(*a*), when the piston 11 is arranged at the bottom dead center, a relatively large side force Fa acts on the circumferential surface of the piston 11 at a position corresponding to twelve o'clock. When the piston 11 approaches the bottom dead center, the length of the piston 11 supported by the cylinder bore 2*a* becomes short. Thus, there is a tendency for the piston 11 to become unstable. Therefore, it is preferable that the second groove 17 not be provided in the vicinity of the twelve o'clock position on the circumferential surface of the piston 11.

Accordingly, in this embodiment, the second groove 17 is provided in the range E extending between the nine o'clock position and the ten thirty position on the circumferential surface of the piston 11, as shown in FIG. 6(*b*).

The following advantages are obtained from the first embodiment having the above structure.

(1) The lubricating oil collected in the first groove 16 is positively supplied to the crank chamber 5 by way of the second groove 17, which extends on the piston 11 so as to extend along the center axis S. Therefore, various parts in the crank chamber 5 such as the coupling portion between the swash plate 9 and the piston 11 are satisfactorily lubricated even when the refrigerant gas from the external refrigerant circuit is drawn into the suction chamber 3*a* without flowing through the suction chamber 3*a*.

(2) The annular first groove 16, which is defined in the circumferential direction of the piston 11, is not exposed from the inside of the cylinder bore 2*a* even when the piston 11 is located at the bottom dead center. Thus, the first groove 16 does not interfere with the edge of the cylinder bore 2*a*. The second groove 17, which extends in the direction of the axis S of the piston 11, also does not interfere with the edge of the cylinder bore 2*a*. Accordingly, the piston 11 reciprocates smoothly. Furthermore, abrasive wear and damage to the piston 11 and the cylinder bore 2*a* are prevented.

(3) The annular first groove 16 collects the adhered lubricating oil from the entire inner circumferential surface of the cylinder bore 2*a*. Thus, it is possible to maximize the amount of lubricating oil supplied into the crank chamber 5.

(4) In the compressor of this embodiment, the rotating movement of the swash plate 9 is converted to reciprocating movement of the piston 11. In such a compressor, the piston 11 is pressed against the inner circumferential surface of the cylinder bore 2*a* by the compression reaction force acting on the swash plate 9 and the inertial force of the piston 11. Accordingly, it is particularly effective to embody the structure of the present invention in such a type of compressor.

(5) The first groove 16 and the second groove 17 are not directly connected to each other on the circumferential surface of the piston 11. The grooves 16, 17 are communicated with each other through the narrow clearance K defined between the piston 11 and the cylinder bore 2*a*. Accordingly, the refrigerant gas in the first groove 16 flows into the second groove 17 in a state restricted by the clearance K. This slows the flow of refrigerant gas. Thus, when the piston 11 is located near the top dead center, the high-pressure refrigerant gas in the cylinder bore 2*a* is prevented from flowing abruptly through the grooves 16, 17 into the cylinder bore 2*a*. As a result, a decrease in the compressing efficiency of the compressor is ultimately prevented.

(6) The inner bottom surface at the distal side of the second groove 17 is a sloped surface that is gradually connected to the circumferential surface of the piston 11. Thus, when the piston 11 moves from the bottom dead center to the top dead center, the distal edge of the second groove 17 is prevented from interfering with the edge of the cylinder bore 2*a*. As a result, the piston 11 moves smoothly while abrasive wear and damage to the piston 11 and cylinder bore 2*a* are positively prevented.

(7) The second groove 17 is defined on the circumferential surface of the piston 11 at a position (the position corresponding to range E in FIG. 6(*b*)) which the influence of the side force Fa produced by the compression reaction force and the inertial force of the piston 11 is minimal. Accordingly, the portion of the second groove 17 in the piston 11 is prevented from being pressed strongly by the cylinder bore 2*a*. This further positively prevents abrasive wear and damage of the piston 11 and the cylinder bore 2*a*.

(8) Since the piston 11, which is hollow, is light in weight, the inertial force of the piston 11 is small. When the inertial force is small, abrasive wear and damage of the piston 11 and the cylinder bore 2*a* is further effectively prevented.

(9) Thermal expansion of the piston 11 takes place as the operation of the compressor gradually increases the temperature of the compressor. The rate of thermal expansion in hollow objects is slightly smaller than that of solid objects. The piston 11 in this embodiment is hollow. This suppresses the clearance K, which is defined between the circumferential surface of the piston 11 and the inner circumferential surface of the cylinder bore 2*a*, from becoming small due to thermal expansion of the piston 11. Thus, an increase in the sliding resistance between the piston 11 and the cylinder bore 2*a* is prevented.

(10) The compressor of this embodiment is a variable displacement compressor, the discharge volume of which may be controlled. In such a compressor, a clutch that transmits and cuts off drive force is not provided between an external drive force and the rotary shaft of the compressor. The external drive force and the compressor are directly connected to each other. Thus, the compressor of this embodiment is operated as long as the external drive source is moving. Satisfactory lubrication of each part is important in such a compressor. In other words, it is very effective to employ the piston 11 of this embodiment, which is provided with the first groove 16 and the second groove 17, in a variable displacement compressor.

The above first embodiment may also be modified as described below.

A further embodiment will now be described with reference to FIG. 8. As shown in an exaggerated manner in FIG. 7, when the piston 11 is located near the top dead center, the piston 11 becomes inclined in the cylinder bore 2*a* in a counterclockwise direction, as viewed in the drawing. This causes the lower side of the first groove 16, as viewed in the drawing, to be opened toward the inner side of the cylinder bore 2*a*. As a result, the high-pressure refrigerant gas compressed in the cylinder bore 2*a* leaks into the first groove 16 and decreases the compressing efficiency.

Figure 8:
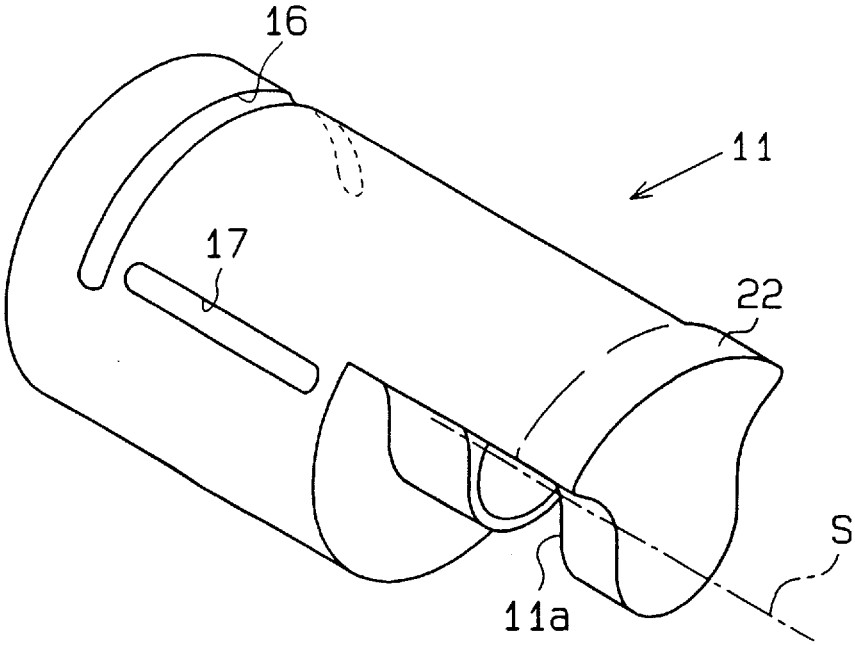
FIG. 8 is a perspective view showing a piston according to a further embodiment.

Thus, in the embodiment of FIG. 8, the first groove 16 is provided only on the upper half of the circumferential surface of the piston 11. In other words, the first groove 16 is defined in the circumferential surface of the piston 11 only within range E2, which extends between nine o'clock and three o'clock, as shown in FIG. 6(*b*). This structure prevents the first groove 16 from being opened toward the inner side of the cylinder bore 2*a* even when the piston 11 located near the top dead center and is inclined as shown in FIG. 7. As a result, the high-pressure refrigerant gas compressed in the cylinder bore 2*a* does not leak into the first groove 16. Thus, a decrease in the compressing efficiency of the compressor is prevented.

Figure 9:
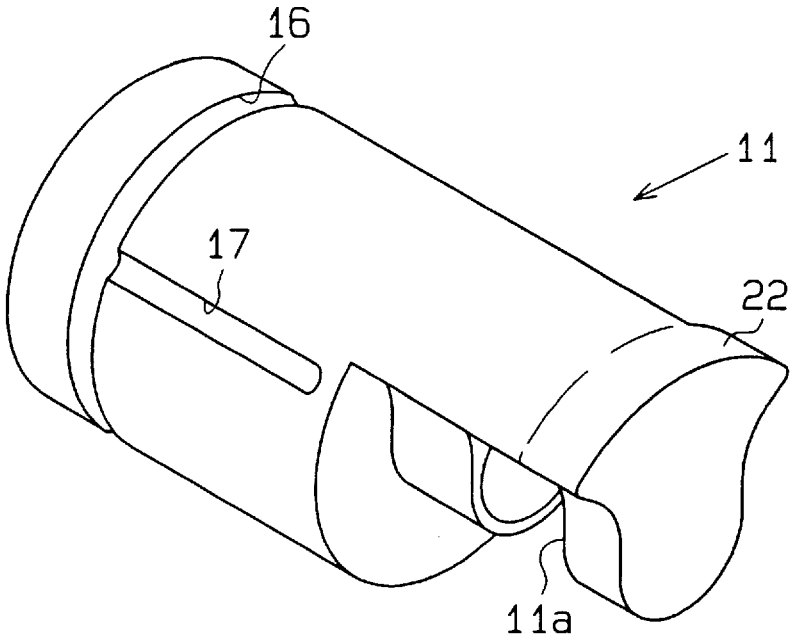
FIG. 9 is a perspective view showing a piston according to a further embodiment.

A further embodiment will now be described. In this embodiment, the second groove 17 is connected to the first groove 16, as shown in FIG. 9. This enables the lubricating oil in the first groove 16 to flow smoothly into the second groove 17.

Figure 10:
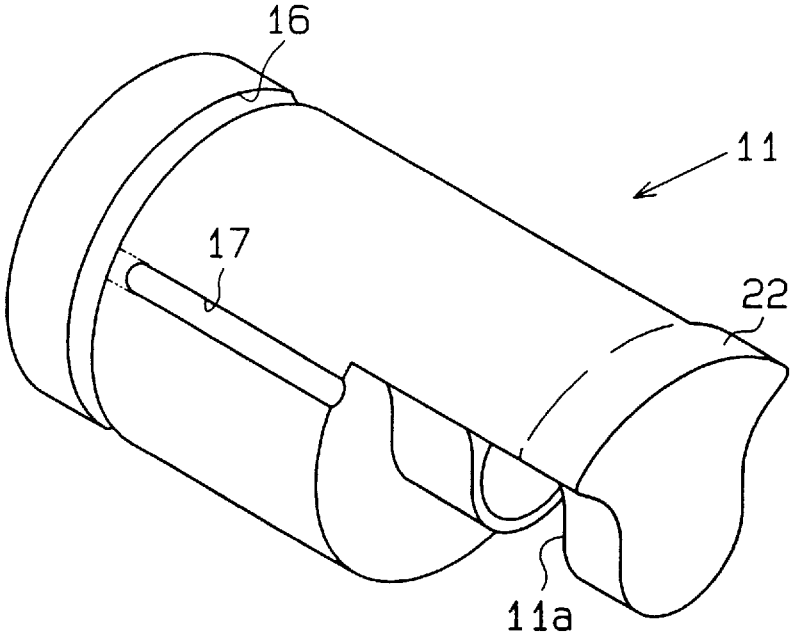
FIG. 10 is a perspective view showing a piston according to a further embodiment.

A further embodiment will now be described with reference to FIG. 10. In this embodiment, the distal end of the second groove 17 extends to the rear peripheral edge of the piston 11 and the second groove 17 is always directly connected with the crank chamber 5. This prevents interference between the distal end of the second groove 17 and the edge of the cylinder bore 2*a* when the piston 11 moves from the top dead center to the bottom dead center. As a result, the piston 11 reciprocates further smoothly, and abrasive wear and damage of the piston 11 and the cylinder bore 2*a* is further securely prevented. In addition, the lubricating oil in the second groove 17 enters the crank chamber 5 more smoothly. As shown in the double-dotted line in FIG. 10, in this embodiment, the second groove 17 may further be connected to the first groove 16 to constantly communicate the first groove 16 with the crank chamber 5 in the same manner as the embodiment of FIG. 9.

Figure 11:
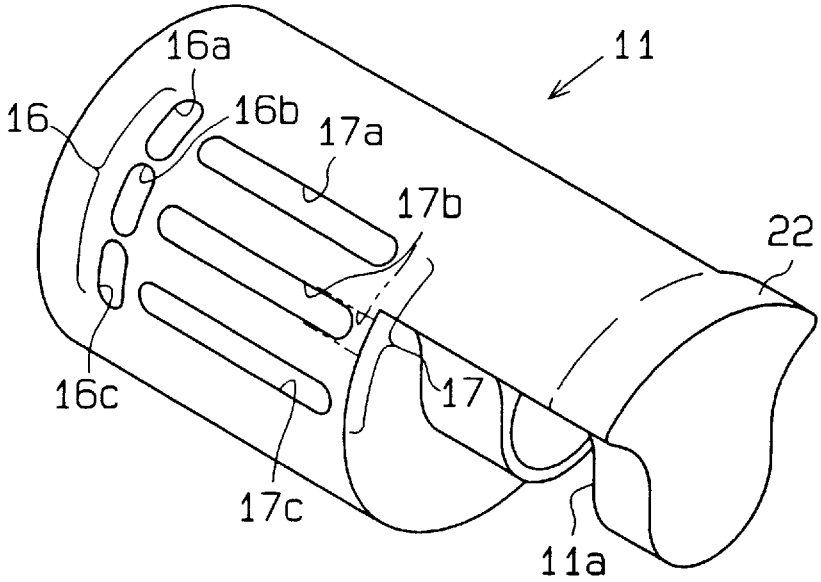
FIG. 11(*a*) is a perspective view showing a piston according to a further embodiment.
Figure 11:
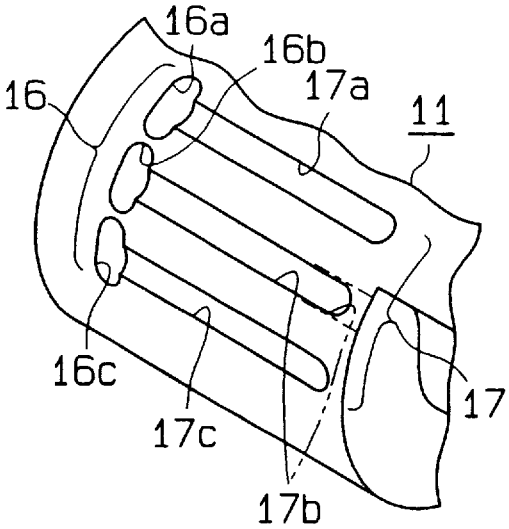
Figure 11:
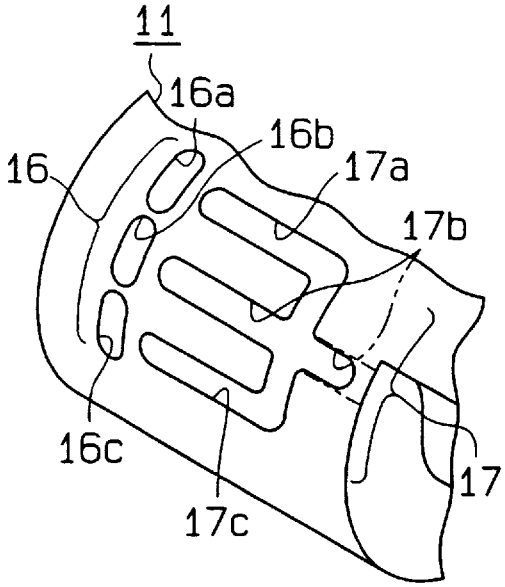

A further embodiment will now be described. As shown in FIG. 11(*a*), a plurality (three in the drawing) of elongated hole like grooves 16*a*, 16*b*, 16*c* are arranged along the circumferential direction of the piston 11. The second groove 17 is constituted by a plurality of grooves 17*a*, 17*b*, 17*c*, each corresponding to the grooves 17*a*, 17*b*, 17*c*, respectively. As shown in the double-dotted line of FIG. 11(*a*), at least one of the three grooves 17*a*, 17*b*, 17*c* constituting the second groove 17 may be extended to the rear peripheral edge of the piston 11 so that it is constantly connected to the crank chamber 5.

As shown in FIG. 11(*b*), in a further information, the grooves 17*a*, 17*b*, 17*c* of the embodiment of FIG. 11(*a*) are each connected to the corresponding grooves 16*a,* 16*b,* 16*c*. As shown in the double-dotted line of FIG. 11(*b*), at least one of the three grooves 17*a,* 17*b,* 17*c* constituting the second groove 17 may be extended to the rear peripheral edge of the piston 11 so that it is constantly connected to the crank chamber 5.

As shown in FIG. 11(*c*), in a further embodiment, the side grooves 17*a,* 17*c* are connected midway of the center groove 17*b* in the second groove 17. As shown in the double-dotted line of FIG. 11(*c*), the center groove 17*b* may be extended to the rear peripheral edge of the piston 11 so that it is constantly connected to the crank chamber 5.

Figure 12:
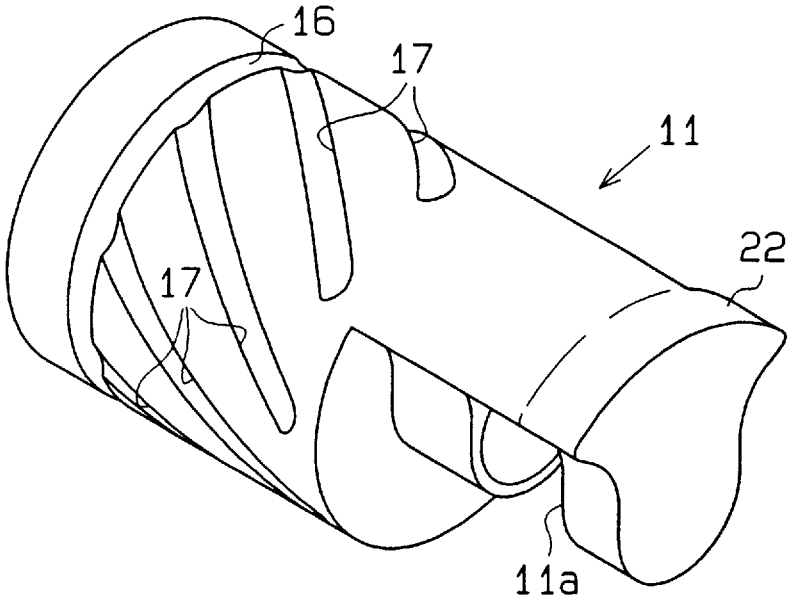
FIG. 12 is a perspective view showing a piston according to a further embodiment.

As shown in FIG. 12, in a further embodiment, a plurality of second grooves 17 extend spirally along the circumferential surface of the piston 11. Although the second grooves 17 are shown connected to the first groove 16 in the drawing, the grooves 17 need not be connected to the first groove 16. The spiral second grooves 17 collect the lubricating oil adhered to the inner circumferential surface of the cylinder bore 2*a* together with the first groove 16. This allows a greater amount of lubricating oil to be collected in the grooves and enables a greater amount of lubricating oil to be supplied into the crank chamber 5. The plurality of second grooves 17 are arranged along the circumferential direction of the piston 11 with an equal interval between one another. This stabilizes the rotating center of the piston 11 when grinding the piston 11 with the centerless grinding method. Thus, the piston 11 may be ground with high accuracy.

As shown in a double-dotted line of FIG. 5, by further embodiment, the second groove 17 is defined in the inner circumferential surface of the cylinder bore 2*a*. The second groove 17 is extended to the edge of the cylinder bore 2*a* so that it is constantly connected to the crank chamber 5. In this case, the circumferential surface of the piston 11 may either be provided or not provided with the second groove 17.

As shown in the double-dotted line of FIG. 6(*b*), in a further embodiment, the second groove 17 is provided within a range E3, which extends between seven thirty to nine o'clock on the circumferential surface of the piston 11. As described above, when a large side force Fa acts on the circumferential surface of the piston 11 at a position corresponding to six o'clock, the range E1, which extends between three o'clock and nine o'clock about the six o'clock position, is strongly pressed against the inner circumferential surface of the cylinder bore 2*a*. However, the most strongly pressed position is the six o'clock position. The pressing force becomes weaker at positions located farther from the six o'clock position. Accordingly, the range E3, which extends separated from the six o'clock position and between seven thirty and nine o'clock, is not as strongly pressed against the inner circumferential surface of the cylinder bore 2*a*. In addition, as shown in FIG. 6(*a*), the value of the side force Fa becomes negative just before the rotational angle of the rotary shaft 6 reaches 90 degrees. This indicates that the side force Fa does not directly act on the circumferential surface of the piston 11 within the range E3 extending between seven thirty and nine o'clock.

Accordingly, there are no problems when the second groove 17 is provided within the range E3, which extends between seven thirty and nine o'clock on the circumferential surface of the piston 11.

A further embodiment according to the present invention will now be described with reference to FIG. 13 to FIG. 18. In this embodiment, parts that are identical to those in the first embodiment will be denoted with the same numeral and will not be described. Generally, parts that differ from the first embodiment will be described hereafter.

Figure 13:
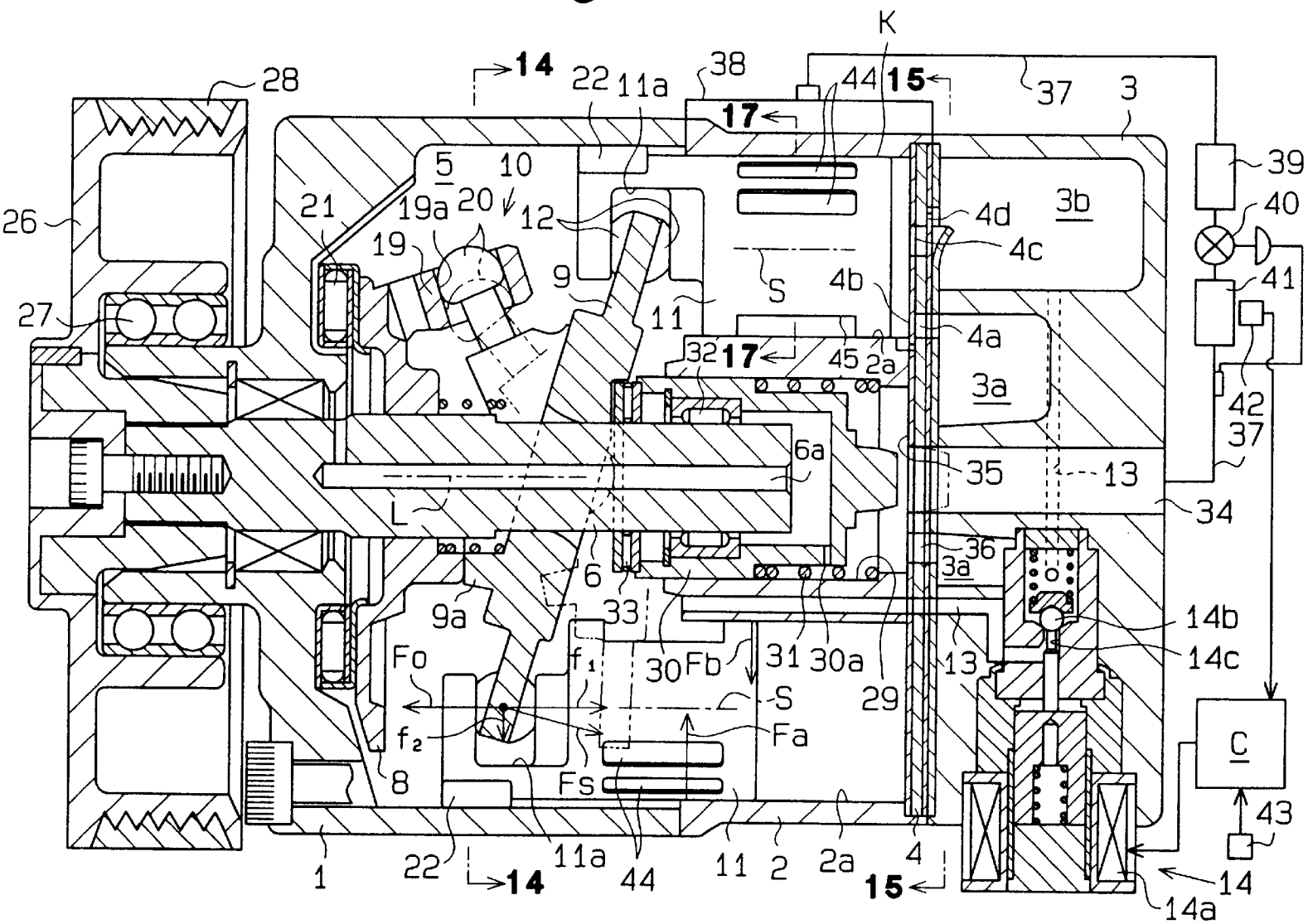
FIG. 13 is a cross-sectional view showing a further embodiment of a compressor according to the present invention.

As shown in FIG. 13, the compressor of this embodiment has a structure that is basically similar to that of the first embodiment. In other words, the rotating movement of the swash plate 9 produced by the rotation of the rotary shaft 6 is converted to reciprocating movement of the piston 11 in the cylinder bore 2*a* by means of the shoes 12.

A pulley 26 is fixed to the front end of the rotary shaft 6. The pulley 26 is rotatably supported by the front end of the front housing 1 by means of an angular bearing 27. The pulley 26 is operatively connected to a vehicle engine (not shown), which is an external drive force, by a belt 28. The angular bearing 27 receives load acting in the thrust direction and the radial direction.

An accommodating hole 29 is defined in the center of the cylinder block 1 and extends along the axis L of the rotary shaft 6. A tubular spool 30 having a closed rear is slidably accommodated in the accommodating hole 29. A coil spring 31 is arranged between the spool 30 and the inner circumferential surface of the accommodating hole 29. The coil spring 31 urges the spool 30 toward the swash plate 9.

The rear end of the rotary shaft 6 is inserted in the spool 30. A radial bearing 32 is arranged between the rear end of the rotary shaft 6 and the inner circumferential surface of the spool 30. The rear end of the rotary shaft 6 is supported by the inner circumferential surface of the accommodating hole 29 by way of the bearing 32 and the spool 30. The bearing 32 may be moved together with the spool 30 along the axis L of the rotary shaft 6. A thrust bearing 33 is arranged on the rotary shaft 6 between the spool 30 and the swash plate 9. The thrust bearing 33 is movable along the axis L of the rotary shaft 6.

A suction passage 34 is defined in the center of the rear housing 3. The suction passage 34 is communicated with the accommodating hole 29. A positioning surface 35 is defined on the valve plate 4 between the accommodating hole 29 and the suction chamber 34. The rear end face of the spool 30 may be abutted against the positioning surface 35. The abutment of the rear end face of the spool 30 against the positioning surface 35 restricts the spool 30 from moving away from the swash plate 9 and also cuts off the communication between the suction passage 34 and the accommodating passage 29.

When the swash plate 9 moves toward the spool 30 as its inclination decreases, the swash plate 9 presses the spool 30 by way of the thrust bearing 33. Thus, the spool 30 is moved toward the positioning surface 35 against the urging force of the coil spring 31. This abuts the spool 30 against the positioning surface 35. The abutment restricts the swash plate 9 so that its inclination is minimal. The minimum inclination of the swash plate 9 is slightly greater than zero degrees. The inclination of the swash plate 9 corresponds to zero degrees when arranged on a plane perpendicular to the rotary shaft 9.

The suction chamber 3*a* is communicated with the accommodating hole 29 through a communicating port 36. When the spool 30 abuts against the positioning surface 35, the communicating port 36 is disconnected from the suction passage 34. A pressure releasing passage 6*a* defined in the rotary shaft 6*a* has an inlet, which is connected with the crank chamber 5, and an outlet, which is connected to the inside of the spool 30. A pressure releasing port 30*a* is defined in the circumferential surface of the spool 30 at its rear end. The pressure releasing hole 30*a* connects the interior of the spool 30 to the accommodating hole 29.

An external refrigerating circuit 37 connects the suction passage 34, through which refrigerant gas is drawn toward the suction chamber 3*a,* and a discharge port 38, through which the refrigerant gas from the discharge chamber 3*b* is discharged. The external refrigerant circuit 37 is provided with a condenser 39, an expansion valve 40, and an evaporator 41. A temperature sensor 42 is arranged in the vicinity of the evaporator 41. The temperature sensor 42 detects the temperature of the evaporator 41 and sends a signal corresponding with the detected temperature to a controller C.

The controller C controls the solenoid 14*a* of the electromagnetic valve 14 in accordance with the signal from the temperature sensor 42. The controller C de-excites the solenoid 14*a* to prevent the forming of frost in the evaporator 41 if the temperature detected by the temperature sensor 42 becomes equal to or lower than a predetermined value when an activating switch 43 for activating an air-conditioning apparatus is turned on. The controller C also de-excites the solenoid 14*a* when the activating switch 43 is turned off.

The high-pressure refrigerant gas in the discharge chamber 3*b* is supplied to the crank chamber 5 when the de-exciting of the solenoid 14*a* opens the supply passage 13. This increases the pressure in the crank chamber 5. Thus, in the same manner as the first embodiment, the swash plate 9 is moved to the minimum inclination. When the spool 30 abuts against the positioning surface 35, the inclination of the swash plate 9 becomes minimum and the suction passage 34 becomes disconnected from the suction chamber 3*a*. Accordingly, the refrigerant gas stops flowing into the suction chamber 3*a* from the external refrigerant circuit 37. This stops the circulation of the refrigerant gas between the external refrigerant circuit 37 and the compressor.

Since the minimum inclination of the swash plate 9 is not zero degrees, the refrigerant gas is drawn into the cylinder bore 2*a* from the suction chamber 3 and discharged into the discharge chamber 3*b* from the cylinder bore 2*a* even when the inclination of the swash plate 9 becomes minimum. Therefore, when the inclination of the swash plate 9 is minimum, the refrigerant gas circulates through a circulation passage in the compressor flowing through the discharge chamber 3*a,* the supply passage 13, the crank chamber 5, the pressure releasing passage 6*a,* the pressure releasing port 30*a,* the suction chamber 3*a,* and the cylinder bore 2*a*. Accordingly, the lubricating oil that flows together with the refrigerant gas lubricates each part in the compressor. A pressure difference is produced between the discharge chamber 3, the crank chamber 5, and the suction chamber 3*a*. The pressure difference and the cross-sectional area of the pressure releasing port 30*a* greatly affect the stabilization of the swash plate 9 at the minimum inclination.

When the exciting of the solenoid 14*a* closes the supply passage 13, the refrigerant gas in the crank chamber 5 flows through the pressure releasing passage 6*a* and the pressure releasing port 30*a* into the suction chamber 3*a*. This causes the pressure in the crank chamber 5 to approach the low pressure in the suction chamber 3*a*. Thus, in the same manner as the first embodiment, the swash plate 9 moves to the maximum inclination.

Figure 14:
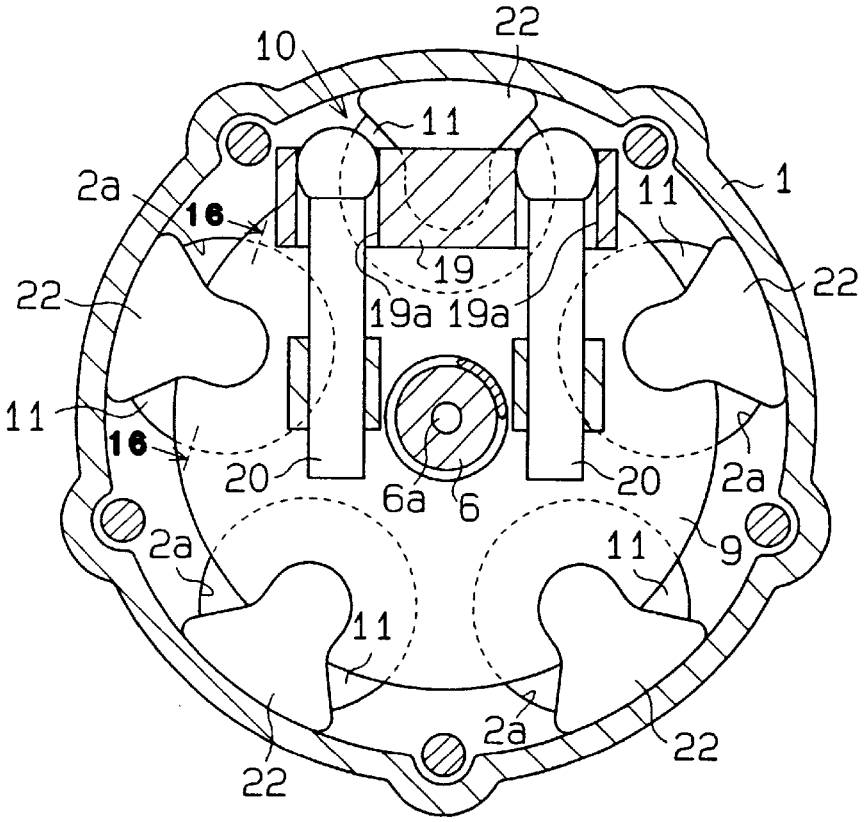
FIG. 14 is a cross-sectional view taken along line 14—14 in FIG. 13.
Figure 15:
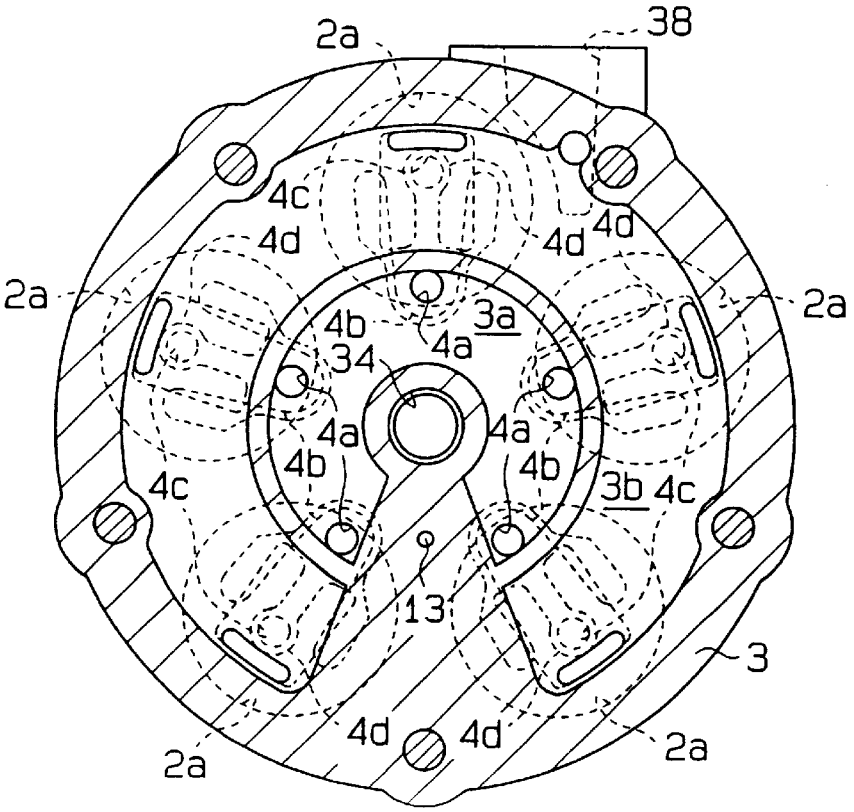
FIG. 15 is a cross-sectional view taken along line 15—15 in FIG. 13.

FIG. 14 is a cross-sectional view taken along line 14—14 in FIG. 13. FIG. 14 mainly shows a hinge mechanism 10, which couples the swash plate 9 and the lug plate 8 to each other, and the rotation restricting member 22, which is provided on the piston 11 to prohibit rotation of the piston 11. FIG. 15 is a cross-sectional view taken along line 15—15 in FIG. 13. FIG. 15 mainly shows the suction chamber 3*a,* which is defined in the rear housing 3, and the relationship between the discharge chamber 3*b* and the cylinder bore 2*a*.

Figure 16:
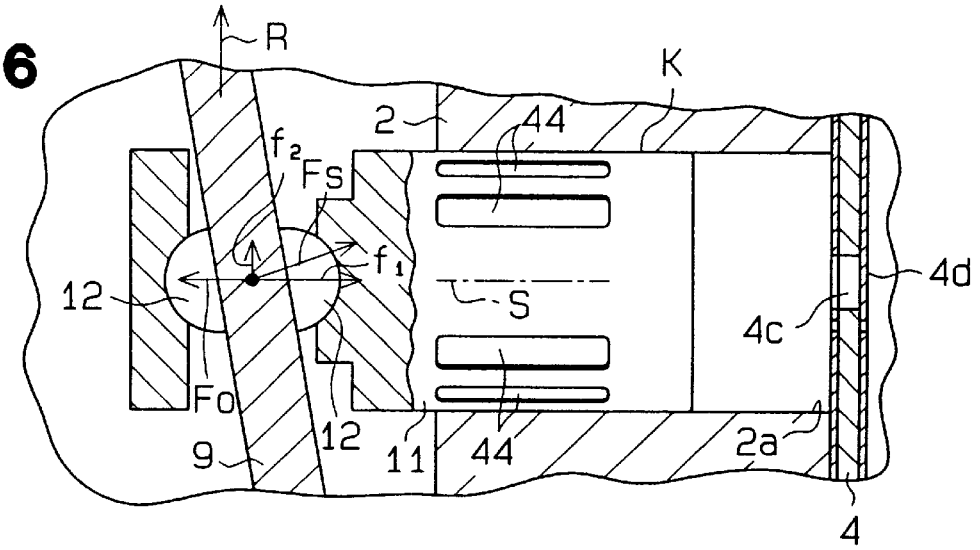
FIG. 16 is a cross-sectional view taken along line 16—16 in FIG. 14.
Figure 17:
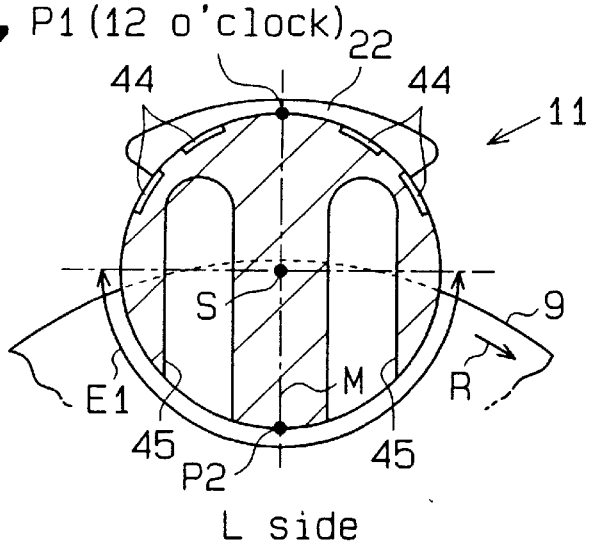
FIG. 17 is a cross-sectional view taken along line 17—17 in FIG. 13.
Figure 18:
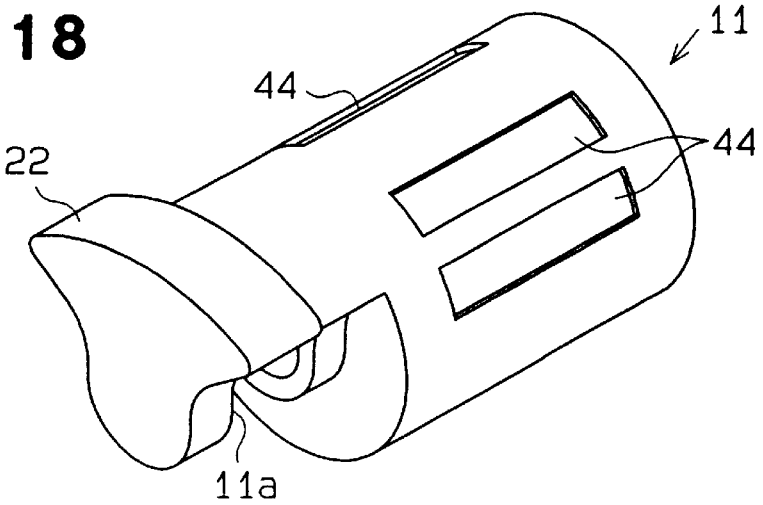
FIG. 18 is a perspective view showing the piston of FIG. 13.

As shown in FIG. 13 and FIGS. 16 to 18, a plurality of grooves 44 are defined along the center axis S of the piston 11 in the outer circumferential surface of the piston 11. In other words, the first groove 16 employed in the first embodiment is not employed in this embodiment. Only the grooves 44, which correspond to the second groove 17, are provided. The grooves 44 are provided in the circumferential surface of the piston 11 at positions described below. As shown in FIG. 17, in the same manner as the first embodiment, when viewing the piston 11 so that the rotating direction R of the rotary shaft 6 is clockwise (in this drawing, the piston 11 is viewed from its front side), the imaginary straight line M extends intersecting the axis L of the rotary shaft 6 and the axis S of the piston 11. Among the two intersecting points P1, P2 at which the straight line M and the circumferential surface of the piston 11 intersect, the position of the intersecting point P1, located at the farther side of the circumferential surface with respect to the axis L of the piston 11, is hereby referred to as the twelve o'clock position.

In FIG. 13, the piston 11 shown at the lower side is arranged at the bottom dead center. When the piston 11 is arranged near the bottom dead center, portions of the grooves 44 are exposed from the cylinder bore 2*a* toward the inside of the crank chamber 5.

As shown in FIG. 17, a pair of recesses 45 are defined in the circumferential surface of the piston 11 at a range E1, which extends between three o'clock and nine o'clock. By providing the recesses 45, the piston 11 becomes hollow. As a result, the weight of the piston 11 is lessened in the same manner as the first embodiment. The recesses 45 are opened to the outer circumferential surface of the piston 11 and extend along the center axis S of the piston 11. Accordingly, in the same manner as the grooves 44, the recesses 45 have the same function as the second groove 17 of the first embodiment.

As described in the first embodiment, when a large side force Fa acts on the six o'clock position at the circumferential surface of the piston 11, a range E1, which extends between three o'clock and nine o'clock about the six o'clock position on the circumferential surface, is strongly pressed against the inner circumferential surface of the cylinder bore 2*a*. In addition, when the piston 11 is arranged at the bottom dead center, a relatively large side force Fa acts on the twelve o'clock position on the circumferential surface of the piston 11.

Furthermore, when the piston 11 is arranged between the top dead center and the bottom dead center during the suction stroke as shown in FIG. 16, the piston 11 receives a reaction force Fs corresponding to the resultant force Fo of the compression reaction force and the inertial force from the swash plate 11. The reaction force Fs is divided into a component force $f_1$, which is directed along the moving direction of the piston 11, and a component force $f_2$, which is directed toward the rotating direction R of the swash plate 9. The component force $f_2$ acts as a force that inclines the rear side of the piston 11 in the direction of the component force $f_2$. In addition, a sliding resistance is provided between the swash plate 9 and the shoes 12. Hence, the rotation of the swash plate 9 produces a force that inclines the rear side of the piston 11 in the same direction as the component force $f_2$. Accordingly, when the rotating speed of the swash plate 9 is high, a large side force Fa acts on the circumferential surface of the piston 11 at the three o'clock position.

Taking into consideration the above, in this embodiment, the grooves 44 are provided on the circumferential surface of the piston 11 at locations excluding the twelve o'clock position and the range E1 that extends between three o'clock and nine o'clock. In other words, the grooves 44 are defined in the circumferential surface of the piston 11 at positions where influence of the side force Fa is small. Accordingly, the portion of the grooves 44 in the piston 11 is prevented from being strongly pressed by the cylinder bore 2*a*. This enables the piston 11 to slide smoothly in the cylinder bore 2*a*.

The lubricating oil adhered to the inner circumferential surface of the cylinder bore 2*a* is also collected in the grooves 44 during the reciprocation of the piston 11 in this embodiment. When the piston 11 moves near the bottom dead center, the grooves 44 become exposed to the inside of the crank chamber 5 from the cylinder bore 2*a,* and the lubricating oil collected in the grooves 44 are supplied to the crank chamber 5. Thus, even if the circumferential surface of the piston 11 is provided with only the grooves 44 that extend along the center axis S of the piston 11, the coupling portion between the swash plate 9 and the piston 11 may be satisfactorily lubricated in the same manner as the first embodiment.

Since this embodiment does not employ the first groove 16 of the first embodiment, problems such as interference between a groove extending in the circumferential direction of the piston 11 and the edge of the cylinder bore 2*a* do not occur. Additionally, the advantageous effects of the first embodiment may be obtained by defining the grooves 44 at locations that receive little influence from the side force Fa. Furthermore, the advantageous effects of having the piston 11 formed in a hollow manner are the same as the first embodiment.

The sliding resistance between the outer circumferential surface of the piston 11 and the inner circumferential surface of the cylinder bore 2*a* becomes greater as the clearance K between the outer circumferential surface of the piston 11 and the inner circumferential surface of the cylinder bore 2*a* becomes smaller. This is due to an adhering force that is produced between the piston 11 and the cylinder bore 2*a* by a force acting between the molecules of the lubricating oil contained in the refrigerant gas. The adhering force becomes smaller as the clearance K becomes larger. The lubricating oil exists between the outer circumferential surface of the piston 11 and the inner circumferential surface of the cylinder bore 2*a*. The refrigerant gas in the cylinder bore 2*a* that leaks into the crank chamber 5 through the clearance K during compression is thus suppressed. It is important that the leakage of the refrigerant gas be suppressed to improve the compressing efficiency of the compressor. Thus, the depth of the grooves 44 is determined so as to minimize the adhering force produced by the force acting between the molecules of the lubricating oil and to be within a range that does not degrade the refrigerant gas leakage suppressing function of the lubricating oil. Such grooves 44 decrease the sliding resistance between the outer circumferential surface of the piston 11 and the inner circumferential surface of the cylinder bore 2*a*.

Like the first embodiment, the compressor of this embodiment is a variable displacement compressor and is thus operated as long as the external drive source is moving. Accordingly, in such a type of compressor, a decrease in the sliding resistance between the piston 11 and the cylinder bore 2*a* prevents a large degree of power loss. Thus, it is extremely effective when the piston 11 provided with the grooves 44 is employed in compressors that are directly connected with the external drive source.

The embodiment of FIG. 13 may be modified in the forms described below.

Figure 19:
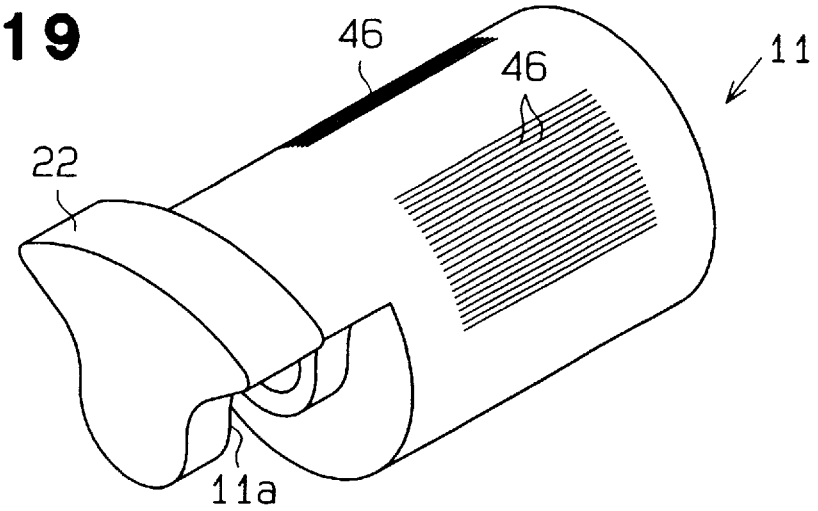
FIG. 19 is a perspective view showing a piston according to a further embodiment.

A further embodiment will now be described. In the embodiment of FIG. 13, the grooves 44, which have a relatively wide width, are defined in the piston 11. However, as shown in FIG. 19, in lieu the grooves 44 of, a plurality of line-like grooves 46 are defined extending along the center axis S in the circumferential surface of the piston 11. The grooves 46 are provided in the circumferential surface of the piston 11 at substantially the same location as the grooves 44. In the same manner as the grooves 44 of the embodiment of FIG. 13, the depth of the grooves 46 is determined so as to minimize the adhering force produced by the force acting between the molecules of the lubricating oil and to be within a range that does not degrade the refrigerant gas leakage suppressing function of the lubricating oil. Accordingly, the advantageous effects of the embodiment of FIG. 13 are also obtained in the embodiment of FIG. 19.

Figure 20:
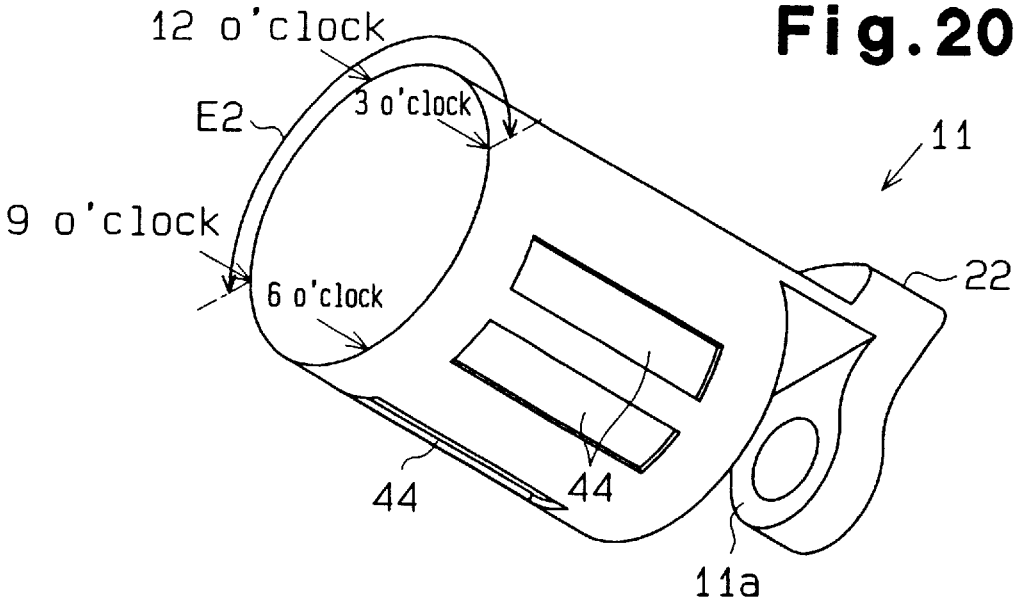
FIG. 20 is a perspective view showing a piston according to a further embodiment.

In a further embodiment, as shown in FIG. 20, the grooves 44 are provided in the circumferential surface of the piston 11 at a location excluding the six o'clock position and the range E2, which extends between nine o'clock and three o'clock. The grooves 44 are identical to the grooves 44 described with reference to the embodiment of FIG. 13. The advantageous effects of the embodiment of FIG. 13 are also obtained in this embodiment.

Figure 21:
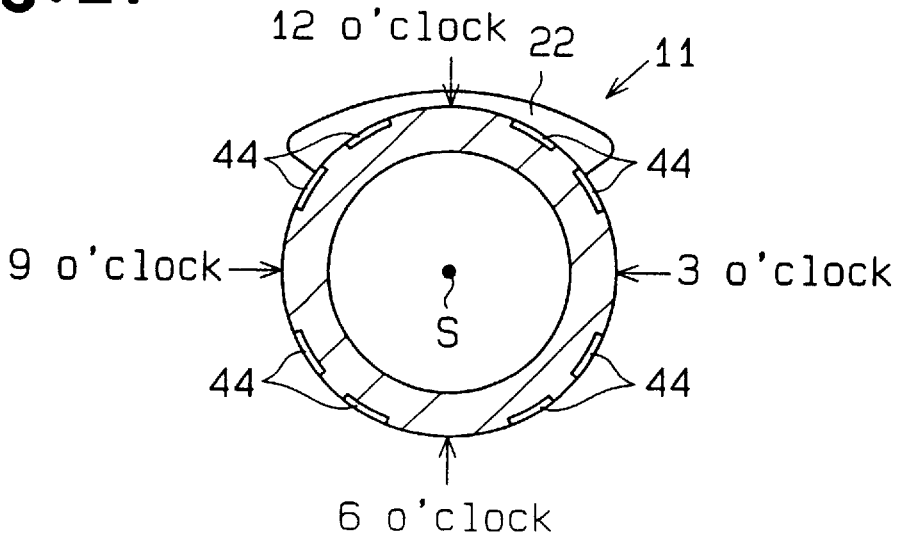
FIG. 21 is a perspective view showing a piston according to a further embodiment.
Figure 22:
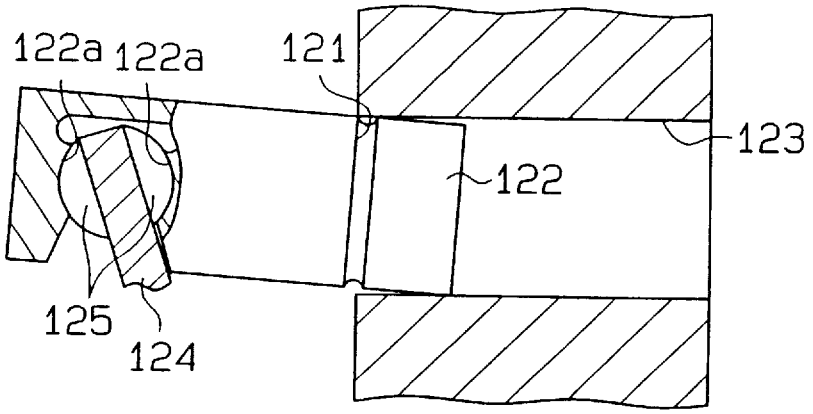
Fig.22 PRIOR ART
FIG. 22 is a partial enlarged cross-sectional view showing a prior art compressor.

In a further embodiment, as shown in FIG. 21, the grooves 44 are provided in the circumferential surface of the piston 11 at a location excluding the twelve o'clock position, the three o'clock position, the six o'clock position, and the nine o'clock position. The grooves 44 are identical to the grooves 44 described in the embodiment of FIG. 13. The piston 11 is formed, for example, by welding the opened end of a tubular body, which has a bottom wall, with a separate member. The advantageous effects of the embodiment of FIG. 13 are also obtained in this embodiment.

The present invention is not limited to the above embodiments and may be further modified as described below.

(1) In each of the above embodiments, the second groove 17 and the grooves 44, 46 may be provided at any position on the circumferential surface of the piston 11. In this case, it is preferable that the second groove 17 and the grooves 44, 46 be provided in the circumferential surface of the piston 11 at a position excluding the six o'clock position, at which the side force Fa is generally maximum. It is more preferable that the second groove 17 and the grooves 44, 46 be provided at a location excluding the twelve o'clock, the three o'clock, and the six o'clock positions. A relatively large side force Fa also acts on the circumferential surface of the piston 11 at the twelve o'clock and three o'clock positions.

(2) In each of the above embodiments, the number, length, depth, and, width of the second groove 17 and the grooves 44, 46 may be altered as required.

(3) In the first embodiment and each of the related embodiments, the depths of the first and second grooves 16, 17 are determined so as to minimize the adhering force produced by the force acting between the molecules of the lubricating oil, and to be within a range that does not degrade the refrigerant gas leakage suppressing function of the lubricating oil. This decreases the sliding resistance between the outer circumferential surface of the piston 11 and the inner circumferential surface of the cylinder bore 2*a*.

(4) In the embodiment of FIG. 13 and each of the related embodiments, the distal end of the grooves 44, 46 may be extended to the rear edge of the piston 11. This constantly connects the grooves 44, 46 with the crank chamber 5.

(5) In the embodiment of FIG. 13 and each of the related embodiments, the inner bottom surface at the distal side of the grooves 44, 46 may be formed as a sloped surface that is gradually connected to the circumferential surface of the piston 11. This prevents the distal edge of the grooves 44, 46 from interfering with the edge of the cylinder bore 2*a* when the piston 11 moves from the bottom dead center to the top dead center.

Figure 23:
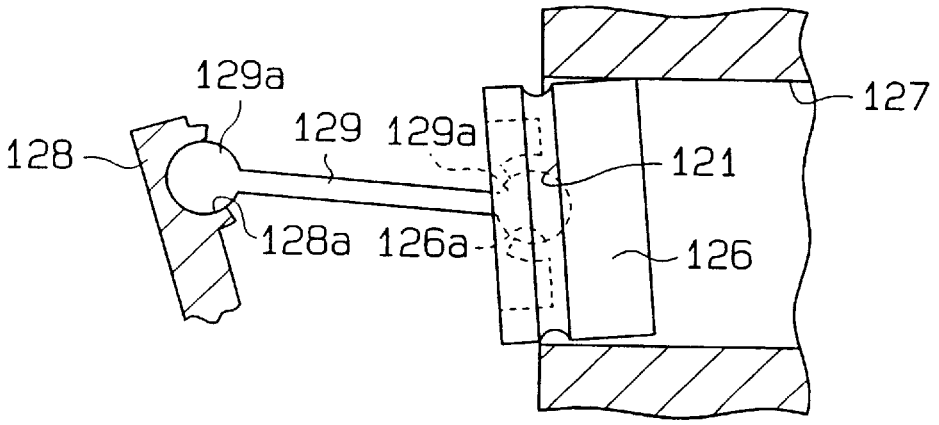
Fig.23 PRIOR ART
FIG. 23 is a partial enlarged cross-sectional view showing another prior art compressor.

(6) The present invention is embodied in a variable displacement compressor provided with a single headed piston. However, the present invention may also be embodied in, for example, a compressor having a swash plate which inclination is fixed, a double headed piston type compressor, a compressor in which the piston is coupled to a wobble plate by a rod as shown in FIG. 23, and a wave cam type compressor. The wave type compressor is a compressor provided with a wave cam having a wave-like cam surface in lieu of the swash plate.

We claim:

1. A piston for use in a compressor having a cylinder bore, a driving body for reciprocating the piston between a top dead center position and a bottom dead center position, the driving body being driven by a rotary shaft, and a crank chamber in which the driving body is located, wherein the piston defines a compression chamber in the cylinder bore and compresses refrigerant gas that includes lubricating oil, the piston comprising:

a central longitudinal axis;

an outer circumferential surface for sliding within the cylinder bore with a fit such that a narrow radial space is present between the outer circumferential surface and the bore; and a communicating groove formed in the outer circumferential surface extending in the same direction as the central longitudinal axis, the communicating groove being located spaced from the compression chamber so that an axial region of said narrow radial space exists between the communicating groove and the compression chamber, and wherein the communicating groove serves to carry lubricating oil to the crank chamber.

2. The piston according to claim 1, wherein the communicating groove is constructed and arranged on the piston such that at least a portion of the communicating groove is exposed to the crank chamber to conduct lubricating oil from the narrow radial space to the crank chamber by way of the communicating groove when the piston is in the bottom dead center position.

3. The piston according to claim 1, wherein the communicating groove is constructed and arranged on the piston such that at least a portion of the communicating groove is exposed to the crank chamber at all times to conduct lubricating oil from the narrow radial space to the crank chamber by way of the communicating groove.

4. The piston according to claim 1, wherein a force-receiving range of the circumferential surface of the piston is strongly pressed against the bore due to the driving force of the driving body, and wherein the communicating groove is located on the piston at a location outside of the force-receiving range.

5. The piston according to claim 4, wherein the central longitudinal axis of the bore is parallel to the longitudinal axis of the rotary shaft, and an imaginary radial line intersects the longitudinal axis of the rotary shaft and the central longitudinal axis of the piston, and wherein a twelve o'clock position is defined as the point of intersection between the outer circumference of the piston and the imaginary line which point is furthest from the longitudinal axis of the rotary shaft, and wherein the communicating groove is located on the piston at a location other than the twelve o'clock, three o'clock and six o'clock positions on the piston as viewed from the end of the rotary shaft that rotates clockwise.

6. The piston according to claim 5, wherein the communicating groove is located at a position that is within a range between the nine o'clock and ten thirty positions on the piston as viewed from the end of the rotary shaft that rotates clockwise.

7. The piston according to claim 5, wherein the communicating groove is located at a position that is within a range between the seven thirty and nine o'clock positions on the piston as viewed from the end of the rotary shaft that rotates clockwise.

8. The piston according to claim 1, wherein the dimensions of the narrow radial space are such that lubricating oil occupies the narrow radial space and thereby hinders leakage of refrigerant from the compression chamber to the crank chamber, and wherein the dimensions of the communicating groove are set so that oil occupies the communicating groove and also hinders leakage of refrigerant from the compression chamber to the crank chamber.

9. The piston according to claim 1, wherein the piston is hollow.

10. The piston according to claim 2, wherein the communicating groove has an end that extends toward a head of the piston and an opposite end that extends toward the crank chamber, and wherein the depth of the communicating groove varies at the end that extends toward the crank chamber such that the communicating groove gradually becomes more shallow in the direction of the crank chamber.

11. The piston according to claim 1, further comprising a lubricant recovering means for collecting oil, wherein the recovering means is located at a position that is always within the cylinder bore regardless of the reciprocating position of the piston such that oil collected by the recovering means is carried to the crank chamber by the communicating groove.

12. The piston according to claim 11, wherein the recovering means is a recovering groove defined in the outer circumferential surface of the piston.

13. The piston according to claim 12, wherein said recovering groove extends in a circumferential direction of the piston.

14. The piston according to claim 13, wherein said recovering groove is an annular groove.

15. The piston according to claim 12, wherein the communicating groove is spaced from the recovering groove in the axial direction of the piston, and wherein the communicating groove communicates with the recovering groove through the narrow radial space.

16. The piston according to claim 12, wherein the communicating groove intersects with and thus directly communicates with the recovering groove.

17. The piston according to claim 12, wherein a part of the piston is strongly pressed against the inner surface of the cylinder bore by the driving force of the driving body, and wherein the communicating groove is provided in the circumferential surface of the piston at a position not corresponding to the part of the piston that is strongly pressed against the inner surface of the cylinder bore.

18. The piston according to claim 17, wherein the central longitudinal axis of the bore is parallel to the longitudinal axis of the rotary shaft, and an imaginary radial line intersects the longitudinal axis of the rotary shaft and the central longitudinal axis of the piston, and wherein a twelve o'clock position is defined as the point of intersection between the outer circumference of the piston and the imaginary line which point is furthest from the longitudinal axis of the rotary shaft, and wherein the communicating groove is located on the piston at a location other than the twelve o'clock, three o'clock and six o'clock positions on the piston as viewed from the end of the rotary shaft that rotates clockwise.

19. A piston-type compressor for compressing refrigerant gas that includes lubricating oil, the compressor comprising:

a housing;

a cylinder bore located in the housing;

a crank chamber located in the housing;

a rotary shaft rotatably supported by the housing;

a driving body mounted on the rotary shaft and located in the crank chamber;

a piston having a central longitudinal axis and accommodated in the cylinder bore to define a compression chamber in the cylinder bore, the piston being coupled to the driving body for reciprocation between a top dead center position and a bottom dead center position in the cylinder bore when the rotary shaft is rotated, the piston having an outer circumferential surface that slides against an inner surface of the cylinder bore, a narrow radial space being present between the outer circumferential surface of the piston and the inner surface of the bore; and a communicating groove formed in the outer circumferential surface of the piston and extending in the same direction as the central longitudinal axis of the piston, the communicating groove being located spaced from the compression chamber so that an axial region of the narrow radial space exists between the communicating groove and the compression chamber, and wherein the communicating groove serves to carry lubricating oil to the crank chamber.

20. The compressor according to claim 19, wherein the communicating groove is constructed and arranged on the piston such that at least a portion of the communicating groove is exposed to the crank chamber to conduct lubricating oil from the narrow space to the crank chamber by way of the communicating groove when the piston is in the bottom dead center position.

21. The compressor according to claim 20, wherein a force-receiving range of the circumferential surface of the piston is strongly pressed against the bore due to a driving force of the driving body, and wherein the communicating groove is located on the piston at a location outside of the force-receiving range.

22. The compressor according to claim 21, wherein the central longitudinal axis of the bore is parallel to the longitudinal axis of the rotary shaft, and an imaginary radial line intersects the longitudinal axis of the rotary shaft and the central longitudinal axis of the piston, and wherein a twelve o'clock position is defined as the point of intersection between the outer circumference of the piston and the imaginary line which point is furthest from the longitudinal axis of the rotary shaft, and wherein the communicating groove is located on the piston at a location other than the twelve o'clock, three o'clock and six o'clock positions on the piston as viewed from the end of the rotary shaft that rotates clockwise.

23. The compressor according to claim 22, wherein the communicating groove is located at a position that is within a range between the nine o'clock and ten thirty positions on the piston as viewed from the end of the rotary shaft that rotates clockwise.

24. The compressor according to claim 22, wherein the communicating groove is located at a position that is within a range between the seven thirty and nine o'clock positions on the piston as viewed from the end of the rotary shaft that rotates clockwise.

25. The compressor according to claim 22, wherein the dimensions of the narrow radial space are such that lubricating oil occupies the narrow radial space and thereby hinders leakage of refrigerant from the compression chamber to the crank chamber, and wherein the dimensions of the communicating groove are set so that oil occupies the communicating groove and also hinders leakage of refrigerant from the compression chamber to the crank chamber.

26. The compressor according to claim 22, wherein the communicating groove has an end that extends toward a head of the piston and an end that extends toward the crank chamber, and wherein the depth of the communicating groove varies at the end that extends toward the crank chamber such that the communicating groove gradually becomes more shallow in the direction of the crank chamber.

27. The compressor according to claim 22, further comprising a lubricant recovering means on the piston for collecting oil, wherein the recovering means is located at a position that is always within the cylinder bore regardless of the reciprocating position of the piston such that oil collected by the recovering means is carried to the crank chamber by the communicating groove.

28. The piston type compressor according to claim 27, wherein said recovering means is a groove extending in a circumferential direction of the piston.

29. The piston type compressor according to claim 28, wherein the communicating groove is separated from the recovering groove, and wherein both grooves are communicated with each other through the narrow radial space.

30. The piston type compressor according to claim 27, wherein a communicating groove is defined in the inner circumferential surface of the cylinder bore.

31. The piston type compressor according to claim 27, wherein said piston is hollow.

32. The piston type compressor according to claim 27, wherein said piston is a single-headed piston provided with a head on one of its ends, wherein said drive body includes a swash plate mounted on the rotary shaft so as to enable integral rotation, wherein said swash plate and the rear side of the piston have a shoe arranged therebetween, and wherein the rotating movement of the swash plate is converted to reciprocating movement of the piston by means of the shoe.

33. The piston type compressor according to claim 27, wherein said piston is a single-headed piston provided with a head on one of its ends, wherein said drive body includes a swash plate mounted on the rotary shaft so as to incline with respect to the rotary shaft, said swash plate altering its inclining angle with respect to the rotary shaft in accordance with the difference in the pressure in the crank chamber and the pressure in a suction chamber, wherein the inclining angle of the swash plate alters the moving stroke of the piston to adjust the displacement of the compressor.

* * * * *

UNITED STATES PATENT AND TRADEMARK OFFICE

CERTIFICATE OF CORRECTION

PATENT NO. : 5,816,134

DATED : October 6, 1998

INVENTOR(S) : Kenji Takenaka, et al.

It is certified that error appears in the above-identified patent and that said Letters Patent is hereby corrected as shown below:

Column 12, line 66, after word "further", change "information" to --embodiment--.

Column 13, line 29, after word "FIG. 5,", change "by" to --in a--.

Signed and Sealed this

Seventeenth Day of August, 1999

*Attest:*

Q. TODD DICKINSON

*Attesting Officer*

*Acting Commissioner of Patents and Trademarks*